US008859484B2

(12) United States Patent
Hulskotter et al.

(10) Patent No.: US 8,859,484 B2
(45) **Date of Patent: *Oct. 14, 2014**

(54) DETERGENT COMPOSITIONS COMPRISING GRAFT POLYMERS HAVING BROAD POLARITY DISTRIBUTIONS

(71) Applicant: The Procter & Gamble Company, Cincinnati, OH (US)

(72) Inventors: Frank Hulskotter, Bad Duerkheim (DE); Darren Rees, West Allotment (GB); Brian Joseph Loughnane, Fairfield, OH (US); Faissal-Ali El-Toufaili, Ludwigshafen (DE); Rainer Anton Dobrawa, Stuttgart (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/789,700

(22) Filed: Mar. 8, 2013

(65) Prior Publication Data

US 2013/0252874 A1 Sep. 26, 2013

Related U.S. Application Data

(60) Provisional application No. 61/608,900, filed on Mar. 9, 2012.

(51) Int. Cl.
*C11D 3/37* (2006.01)

(52) U.S. Cl.
CPC ..... *C11D 3/3788* (2013.01); *C11D 3/3707* (2013.01); *C11D 3/3753* (2013.01)
USPC ..... 510/475; 510/220; 510/230; 510/276; 510/360; 8/137

(58) Field of Classification Search
USPC ..... 510/220, 230, 276, 360, 475; 8/137
See application file for complete search history.

(56) References Cited

U.S. PATENT DOCUMENTS

| | | | |
|---|---|---|---|
| 4,746,456 | A | 5/1988 | Kud et al. |
| 4,846,994 | A | 7/1989 | Kud et al. |
| 4,846,995 | A | 7/1989 | Kud et al. |
| 4,904,408 | A | 2/1990 | Kud et al. |
| 4,908,150 | A | 3/1990 | Hessel et al. |
| 5,049,302 | A | 9/1991 | Holland et al. |

(Continued)

FOREIGN PATENT DOCUMENTS

| | | |
|---|---|---|
| DE | 10245858 | 4/2004 |
| DE | 102006055473 | 7/2007 |

(Continued)

OTHER PUBLICATIONS

International Search Report for PCT EP 2007/055198, dated Sep. 17, 2007, containing 38 pages.

(Continued)

*Primary Examiner* — Brian P Mruk
(74) *Attorney, Agent, or Firm* — Melissa G Krasovec

(57) ABSTRACT

The present invention relates to a detergent composition containing an amphiphilic graft polymer based on water-soluble polyalkylene oxides (A) as a graft base and side chains formed by polymerization of a vinyl ester component (B), where the polymer has a broad polarity distribution.

11 Claims, 10 Drawing Sheets

(56) References Cited

U.S. PATENT DOCUMENTS

| | | | | |
|---|---|---|---|---|
| 5,082,585 | A | 1/1992 | Hessel et al. | |
| 5,318,719 | A | 6/1994 | Hughes et al. | |
| 5,576,282 | A | 11/1996 | Miracle et al. | |
| 5,635,554 | A | 6/1997 | Boeckh et al. | |
| 5,733,856 | A | 3/1998 | Gopalkrishnan et al. | |
| 5,756,444 | A | 5/1998 | Walters et al. | |
| 5,952,432 | A | 9/1999 | Yamaguchi et al. | |
| 5,980,931 | A | 11/1999 | Fowler et al. | |
| 6,121,165 | A | 9/2000 | Mackey et al. | |
| 6,271,307 | B1 | 8/2001 | Huff et al. | |
| 6,306,812 | B1 | 10/2001 | Perkins et al. | |
| 6,326,348 | B1 | 12/2001 | Vinson et al. | |
| 6,455,486 | B1 | 9/2002 | Kerobo et al. | |
| 7,465,701 | B2 | 12/2008 | Sharma et al. | |
| 7,951,768 | B2 * | 5/2011 | Boutique et al. | 510/475 |
| 7,998,279 | B2 * | 8/2011 | Schutz et al. | 134/25.2 |
| 8,143,209 | B2 * | 3/2012 | Boeckh et al. | 510/475 |
| 8,426,023 | B2 | 4/2013 | Sharavanan et al. | |
| 2003/0224025 | A1 | 12/2003 | Gotsche et al. | |
| 2006/0270582 | A1 | 11/2006 | Boeckh et al. | |
| 2007/0068557 | A1 | 3/2007 | Ortiz et al. | |
| 2007/0281879 | A1 * | 12/2007 | Sharma et al. | 510/475 |
| 2008/0015135 | A1 | 1/2008 | Buzzaccarini et al. | |
| 2009/0214946 | A1 | 8/2009 | Shen et al. | |
| 2009/0298735 | A1 | 12/2009 | Boeckh et al. | |
| 2011/0054071 | A1 | 3/2011 | Mattmann et al. | |
| 2012/0214941 | A1 | 8/2012 | Kleiner et al. | |

FOREIGN PATENT DOCUMENTS

| | | | | |
|---|---|---|---|---|
| EP | 0358472 | A2 | 3/1990 | |
| EP | 0358473 | A2 | 3/1990 | |
| EP | 0358474 | A2 | 3/1990 | |
| EP | 0786514 | | 7/1997 | |
| GB | 922457 | | 4/1963 | |
| GB | 2039938 | A | 8/1980 | |
| GB | 2304726 | A | 3/1997 | |
| WO | WO 94/16052 | A1 | 7/1994 | |
| WO | WO 95/22593 | A1 | 8/1995 | |
| WO | WO 99/05242 | A1 | 2/1999 | |
| WO | WO 02/48297 | A1 | 6/2002 | |
| WO | WO 02/50223 | A1 | 6/2002 | |
| WO | WO 2004/041982 | A1 | 5/2004 | |
| WO | WO 2005/035706 | A2 | 4/2005 | |
| WO | WO 2006/130442 | A1 | 12/2006 | |
| WO | WO 2006/130575 | A2 | 12/2006 | |
| WO | WO 2007/138054 | * | 12/2007 | C11D 3/37 |

OTHER PUBLICATIONS

International Search Report for PCT/US2013/029781, dated Jun. 21, 2013, containing 6 pages.

EP file wrapper for EP 2024479, granted, Jul. 21, 2010.

* cited by examiner

DETERGENT COMPOSITIONS COMPRISING GRAFT POLYMERS HAVING BROAD POLARITY DISTRIBUTIONS

CROSS REFERENCE TO RELATED APPLICATION

This application claims the benefit of U.S. Provisional Application No. 61/608,900, filed Mar. 9, 2012.

FIELD OF THE INVENTION

The present invention relates to a detergent composition containing an amphiphilic graft polymer based on water-soluble polyalkylene oxides (A) as a graft base and side chains formed by polymerization of a vinyl ester component (B), where the polymer has a broad polarity distribution.

BACKGROUND OF THE INVENTION

Graft polymers based on polyalkylene oxides and vinyl esters, in particular vinyl acetate, are known from DE-B-1 077 430 and GB-B-922 457. They are prepared by polymerizing the vinyl ester in the presence of the polyalkylene oxide, the initiator used being dibenzoyl peroxide, dilauroyl peroxide or diacetyl peroxide. In the examples of these documents, the procedure is to prepare a solution from all reactants. This solution is either heated directly to the polymerization temperature or only a portion is initially charged and heated or the majority is metered in. In the first variant, it is also possible for larger amounts of solvent such a methyl acetate or methanol to be present (100% or 72% based on the amount of polyalkylene glycol and vinyl ester). Further procedures are merely mentioned in GB-B-922 457 but not used in the examples for preparing the graft polymers.

According to EP-A-219 048 and EP-285 037, graft polymers based on polyalkylene oxides and vinyl esters are suitable as graying inhibitors in the washing and after treatment of textiles comprising synthetic fibers. For this purpose, EP-A-285 935 and EP-285 038 also recommend graft polymers which comprise methyl acrylate or N-vinylpyrrolidone in copolymerized form as an additional graft monomer. For the preparation of the graft polymers used in the examples, no specific data are given and reference is made merely in general terms to DE-B-1 077 430 and GB-B-922 457.

The document WO 2009/013202 A1 describes a process for preparing copolymers in solid form wherein the copolymers are obtained by free-radically initiated polymerization of a mixture of 30 to 80% by weight of N-vinyllactam, 10 to 50% by weight of the vinyl acetate and 10 to 50% by weight of a polyether, in the presence of at least one solvent, with the proviso that the sum is 100% by weight, characterized in that the solvents are removed from the polymerization mixture with the aid of an extruder.

The document WO 2007/138054 A1 relates to laundry detergents and cleaning compositions comprising amphiphilic graft polymers based on water-soluble polyalkylene oxides (A) as a graft base and side chains formed by polymerization of a vinyl ester component (B), said polymers having an average of ≤1 graft site per 50 alkylene oxide units and mean molar masses $M_w$ of from 3,000 to 100,000 g/mol. The invention further relates to the use of these amphiphilic graft polymers as a soil detachment/promoting additive to laundry detergents and cleaning compositions.

The document DE 10 2006 055 473 A1 describes a process for the preparation of graft polymers on the basis of polyethers and vinyl esters by conversion of polyethers, vinyl ester and further hydrophobic monomers in the presence of an organic solvent and a radical forming polymerization initiator under reflux conditions.

The document WO 2011/054789 A1 relates to a method for producing aqueous solutions of homo or copolymers of acrylic acid by means of radical polymerization of acrylic acid and optional water-soluble, monoethylene unsaturated comonomers in an aqueous medium in the presence of at least one water-soluble initiator and at least one water-soluble regulator, wherein the polymerization is performed by means of a continuous process, and wherein low-molecular components are at least partially separated out of the aqueous polymer solution obtained after polymerization. Microstructured mixers and reactors are preferably used for the polymerization. At least one reactor and/or mixer having microstructures are preferably used for the process.

The document DE 102 45 858 A1 describes the use of water-soluble or water-dispersible, film building graft polymers which are obtainable by a radical polymerization of a vinyl ester of an aliphatic C1 to C24 carbonic acid in the presence of polyether with the mean molecular weight of at least 300 g/mol.

The document WO 2009/133186 A1 relates to a method for the continuous production of a polymer by radical polymerization, wherein at least three materials are mixed with microstructures in one or more mixers and are then polymerized in at least one reaction zone.

The document DE 198 14 739 A1 describes the use of polyalkylene oxide based graft polymers as solubilizers. The graft polymers are obtainable by grafting of a) polyalkylene oxide with
b) at least one monomer, selected from the group
   - b1) C1-C30-alkylesters of monoethylenic unsaturated C3-C8-carboxylic acids;
   - b2) vinyl esters of aliphatic C1-C30-carboxylic acids;
   - b3) C1-C30-alkylvinylethers;
   - b4) N—C1-C12-alkyl-substituted amides of monoethylenic unsaturated C3-C8-carboxylic acids
   - b5) N,N—C1-C12-dialkyl substituted amides of monoethylenic unsaturated C3-C8-carboxylic acids as solubilizers.

The document WO 2007/138053 A1 describes novel amphiphilic graft polymers based on water-soluble polyalkylene oxides (A) as a graft base and side chains formed by polymerization of a vinyl ester component (B), said polymers having an average of ≤1 graft site per 50 alkylene oxide units and mean molar masses $M_w$ of from 3,000 to 100,000 g/mol. The inventive process describes the semi-batch process whereby the used reactor is preferably a stirred tank.

Processes for the preparation of graft polymers based on polyalkylene oxides are limited by their process parameters, since heat removal represents a considerable safety aspect. For this reason, longer reaction times are required, e.g., usually several hours. Amphiphilic graft polymers obtained in semi-batch processes, which are characterized by limited process parameters, are restricted in the structure variations. As a result, the nature of semi-batch-made graft polymers is that their polarity distributions are relatively narrow.

It would be desirable to produce a detergent composition containing an amphiphilic graft polymer having a broader polarity distribution. Graft polymers having broad polarity distributions provide a broader variety of cleaning benefits by treating and/or suspending a broader spectrum of soils. Graft polymers having narrow polarity distributions provide more limited cleaning benefits.

SUMMARY OF THE INVENTION

In one aspect, the present disclosure provides a detergent composition comprising an amphiphilic graft polymer based on water-soluble polyalkylene oxides (A) as a graft base and side chains formed by polymerization of a vinyl ester component (B), where the polymer has a mean molar mass ($M_w$) of from 3000 to 100,000 and where the polymer comprises (A) from 15% to 70% by weight of a water-soluble polyalkylene oxide as a graft base and (B) side chains formed by free-radical polymerization of from 30 to 85% by weight of a vinyl ester component composed of (B1) from 70 to 100% by weight of vinyl acetate and/or vinyl propionate and (B2) from 0 to 30% by weight of a further ethylenically unsaturated monomer, where the polymer has a full width at half maximum of the polarity distribution between 0.35 and 1.0. Other aspects of the invention include methods of laundering fabric.

BRIEF DESCRIPTION OF THE DRAWINGS

FIG. 1 illustrates a process according to the invention. In FIG. 1, a polyalkylene oxide (A) supply is illustrated, whereby the amount of polyalkylene oxide (A) is in this example 100% of the total amount. In particular, the components (A), (B) and (C) are supplied in form of a stream. This is illustrated by the letters "A, B, C" and the arrows. The polyalkylene oxide (A) stream, optionally combined with an additive (D) stream, flows into the first feed side (1) of the first tubular reactor segment (2). Additionally, 25% of the total amount of a vinyl ester component (B) is fed to the first feed site (1) together with 50% of the total amount of an initiator (C). The three streams are mixed in the first feed side (1) and continue to flow into the first tubular reactor segment (2). In this first tubular reactor segment (2) the polymerisation takes place. The stream continues to flow into the direction of the first outlet side (3), which corresponds to the second feed side (1*a*) of the second tubular reactor segment (2*a*). At the first outlet side (3) further 25% of the total amount of the vinyl ester component (B) is introduced. From the first outlet side (3) of the first tubular reactor segment (2) a recycle stream (4) is removed from the first outlet side (3) to the first feed side (1) of the first tubular reactor segment (2). In FIG. 1, five tubular reactor segments (2, 2*a*, 2*b*, 2*c*, 2*d*) are connected in series, whereby the first four tubular reactor segments (2, 2*a*, 2*b*, 2*c*) have a recycle stream (4, 4*a*, 4*b*, 4*c*). In between the tubular reactor segments (2, 2*a*, 2*b*, 2*c*) 25% of the total amount of component (B) flows into each the feed side (1*a*, 1*b*, 1*c*), whereas at the beginning 50% and before the last tubular reactor segment (2*d*) also 50% of the total amount of component (C) flows into the feed sides (1,1*d*). After the reaction mixture flows or streams through the last tubular reactor segment (2*d*) into the outlet side (3*d*), the desired stream of an amphiphilic graft polymers (P) is obtained.

FIG. 2 illustrates a process according to the invention. FIG. 2, in contrast to FIG. 1, shows four tubular reactor segments connected in series, whereby only the first and the third tubular reactor segments (2, 2*b*) have a recycle stream (4, 4*a*) from the outlet sides (3, 3*b*) to the feed sides (1, 1*b*). The first tubular reactor segment (2) is fed over the feed side (1) with 100% of the total amount of component (A) and 50% of components (B) and (C). At a later stage of this process again 50% of components (B), fed into feed side (3*a*) and (C), fed into feed side (3*b*), is supplied.

FIG. 3 illustrates a process according to the invention. In FIG. 3, four tubular reactor segments are connected in series. 100% of the total amount of component (A) flows through the first feed side (1) into the first tubular reactor segment (2). In addition to this, 50% of the total amount of components (B) and (C) are also supplied to the first feed side (1). At a later stage in this process the residues of the components (C), (B) are supplied into feed side (3*a*), whereby each is 50% of the total amount In this embodiment the first feed side (1) has a temperature that is below T2 and higher than T3. T2 is the temperature at which the half-time of initiator (C) decomposition is above 500 minutes. T3 is the melting point of the reaction mixture. The tubular segments have a temperature at which the decomposition half-time of the initiator (C) is lower than 120 minutes.

FIG. 4 shows molecular weight distribution determined by size exclusion chromatography. In the case where a nonionic surfactant is used as an additive, this can be seen as one peak in the range of 1000-3000 g/mol. The graft polymer can be seen at higher molecular weight.

FIG. 5 shows a GPEC chromatogram. Gradient polymer elution chromatography (GPEC, as described in W. J. Staal "Gradient Polymer Elution Chromatography" Ph. Thesis Eindhoven University of Technology, The Netherlands 1996) is used to separate copolymers according their chemical composition. The separation mechanism of GPEC is based on a combination of precipitation/redissolving mechanism and a mechanism controlled by column interactions (absorption and steric exclusion). The name GPEC does not refer to a specific mechanism but solely describes the technique (Gradient Elution Chromatography) and the application (polymers). In general the working principle of GPEC can be described as follows. A polymer sample is dissolved in a good solvent (tetrahydrofuran). The polymer solution is injected into a non-solvent or a combination of solvent (water)/non-solvent (acetonitrile). The initial conditions are poor in solubility terms for the polymer molecules and phase separation will occur. Two phases are formed: a polymer rich phase and a highly diluted solvent phase. After phase separation the polymer molecules are retained in the system. After injection, a gradient from the initial conditions to the good solvent is applied and during this gradient redissolving of the polymer molecules occurs. The redissolving point (expressed in volume fraction solvent or non-solvent) highly depends on the molar mass and the chemical composition of the polymer molecule. When the polymer molecule is redissolved, interactions with the stationary phase (column interactions) will further control the separation (as described in Cools, Paul J. C. H. "Characterization of copolymers by gradient polymer elution chromatography" Ph. Thesis Eindhoven University of Technology, The Netherlands 1999).

FIG. 6 shows a schematic representation of polarity and polarity distribution.

FIG. 7 shows a calculation of polarity distribution.

DETAILED DESCRIPTION OF THE INVENTION

Amphiphilic Graft Polymers

Figure 1:
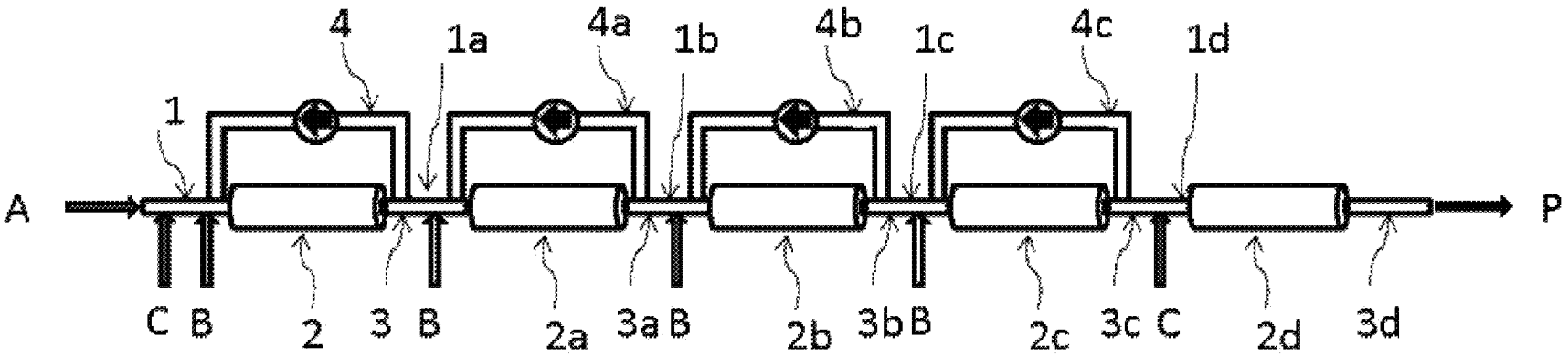
In FIG. 1 to FIG. 7, the following references are used: A Polyalkylene oxide (stream); B Vinyl ester component (stream); C Initiator (stream); P Product (stream).
Figure 2:
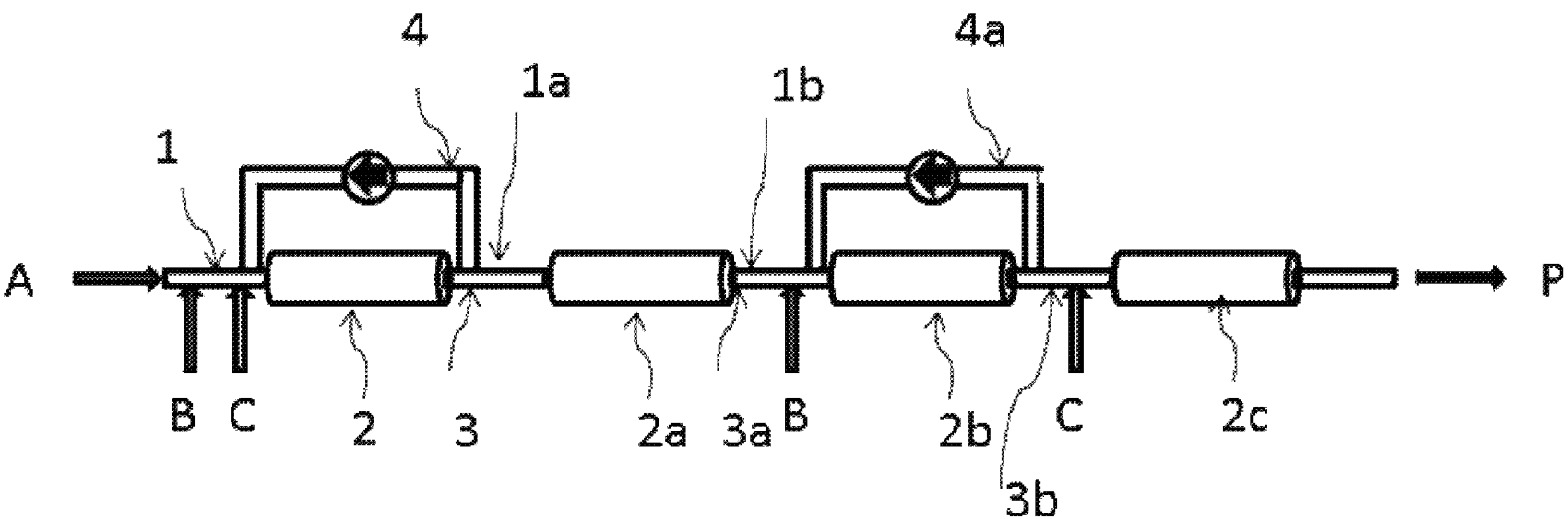
Figure 3:
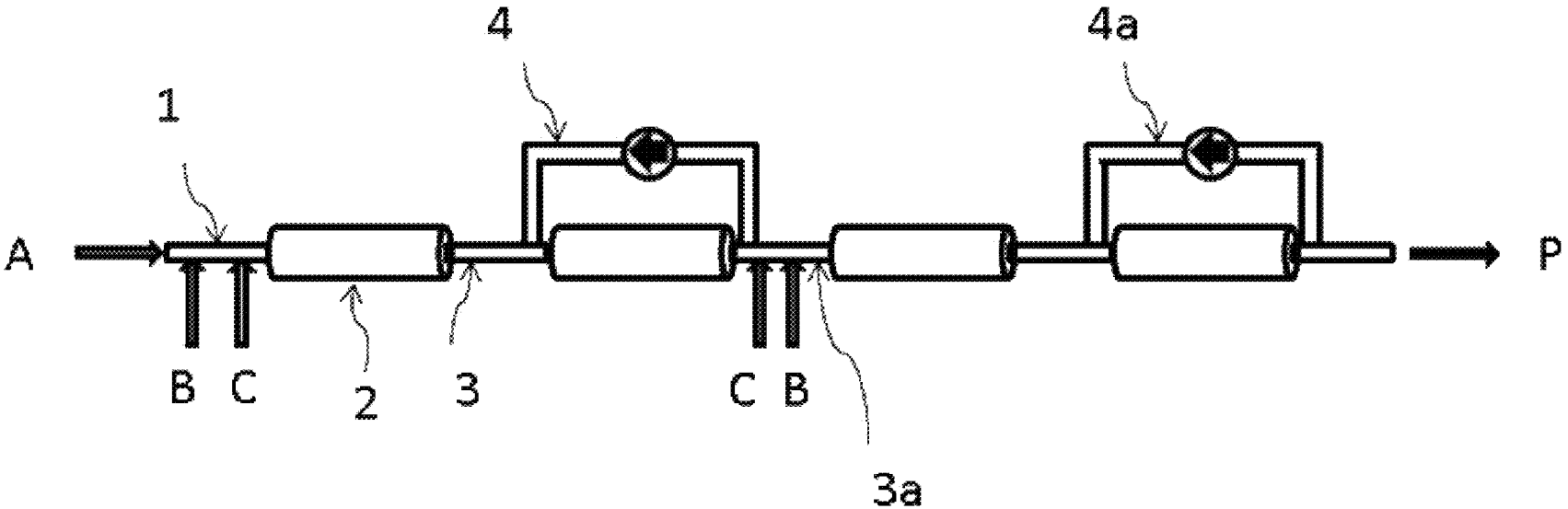
Figure 4:
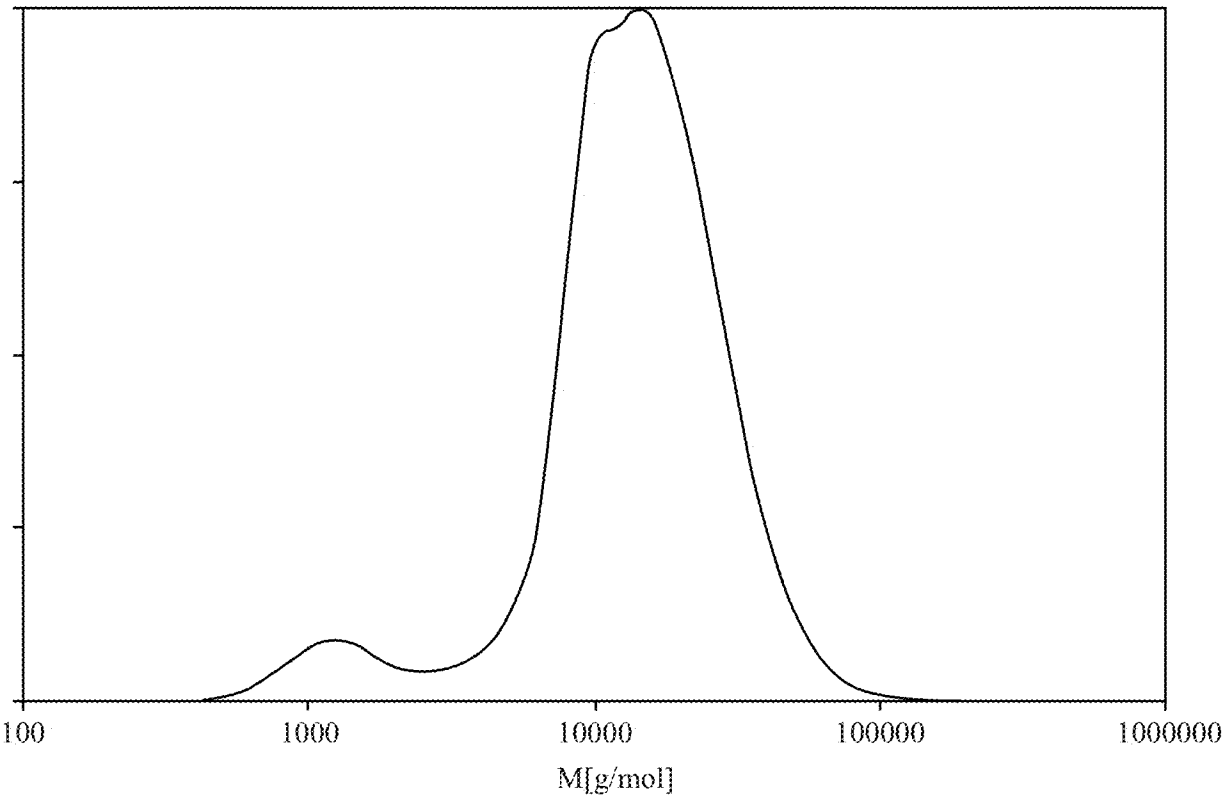
Figure 5:
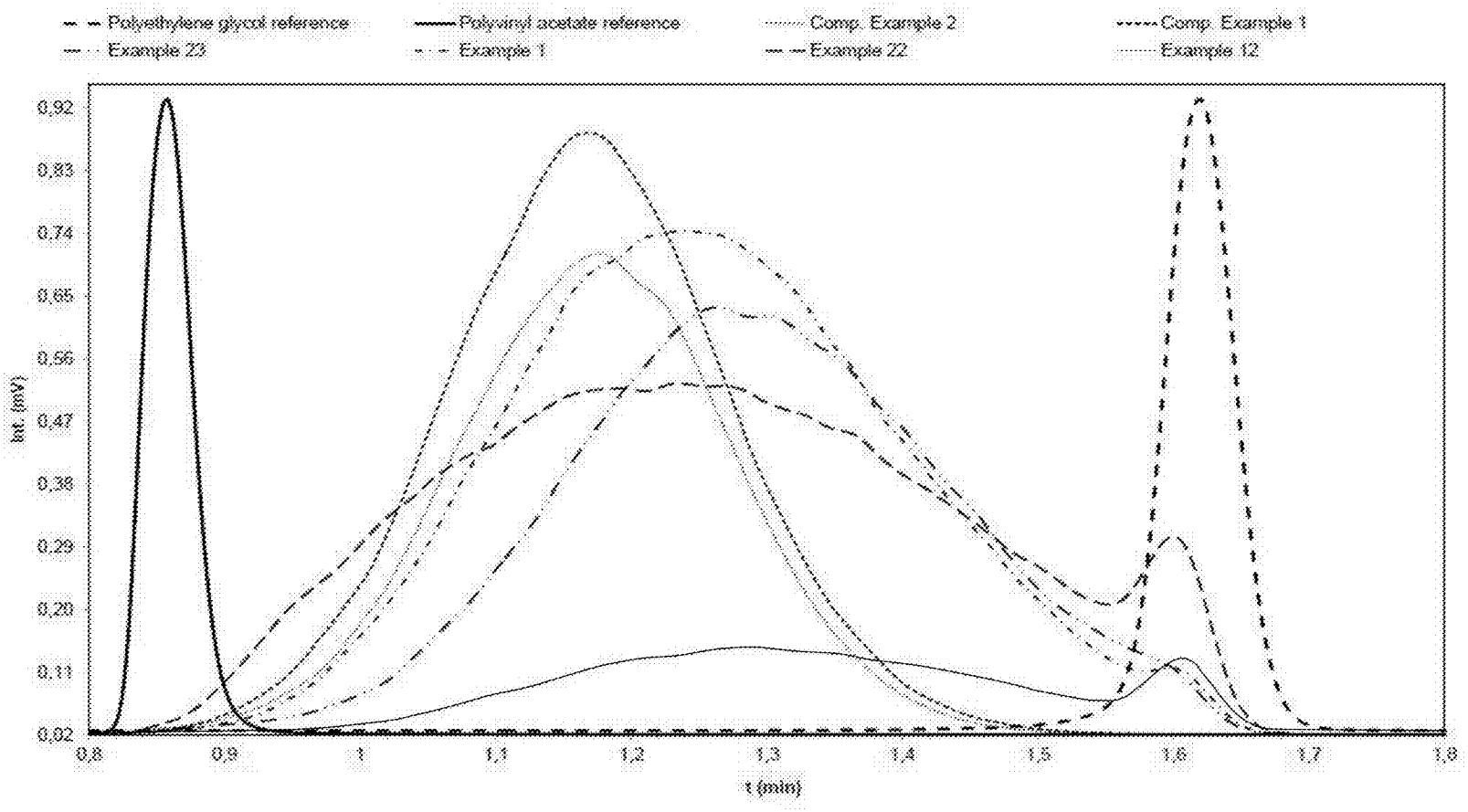
Figure 6:
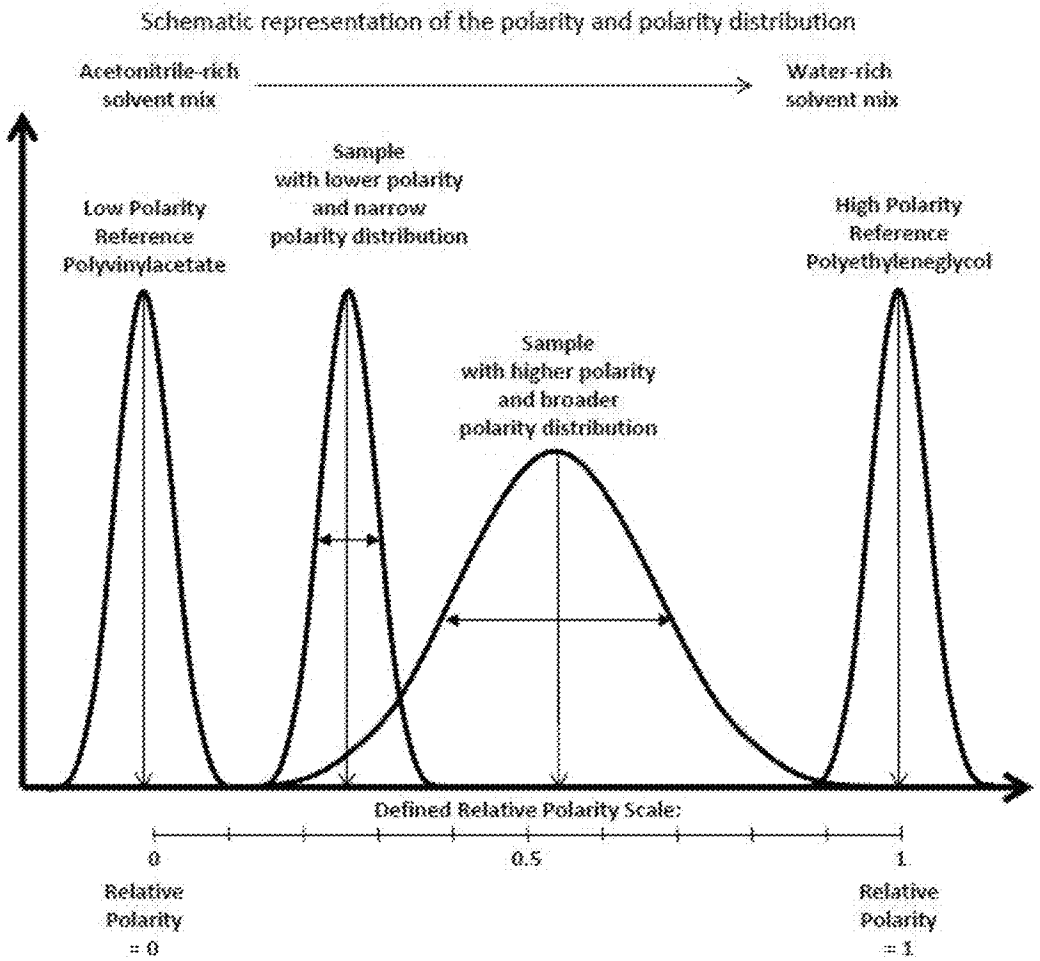
Figure 7:
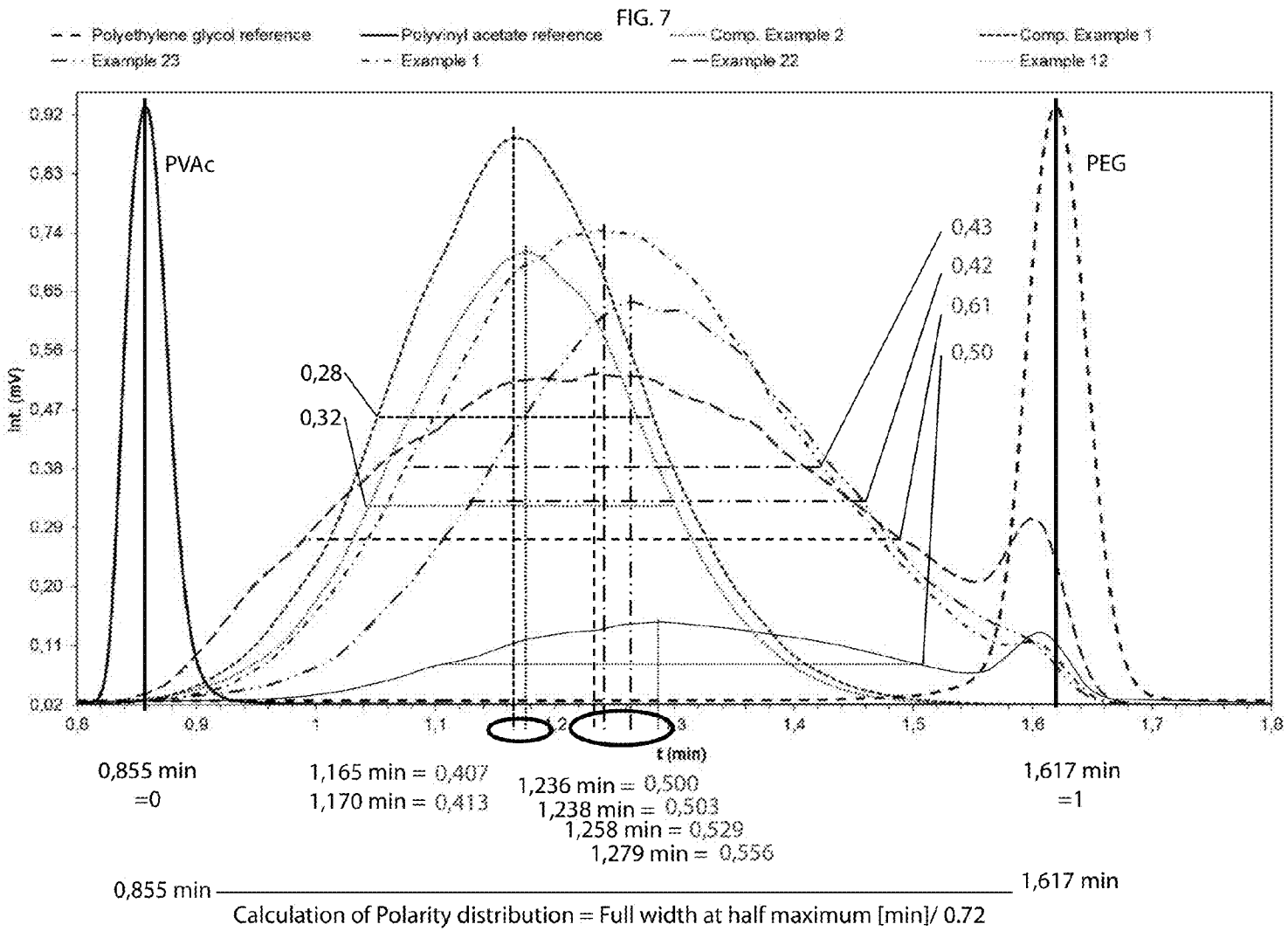
Figure 8:
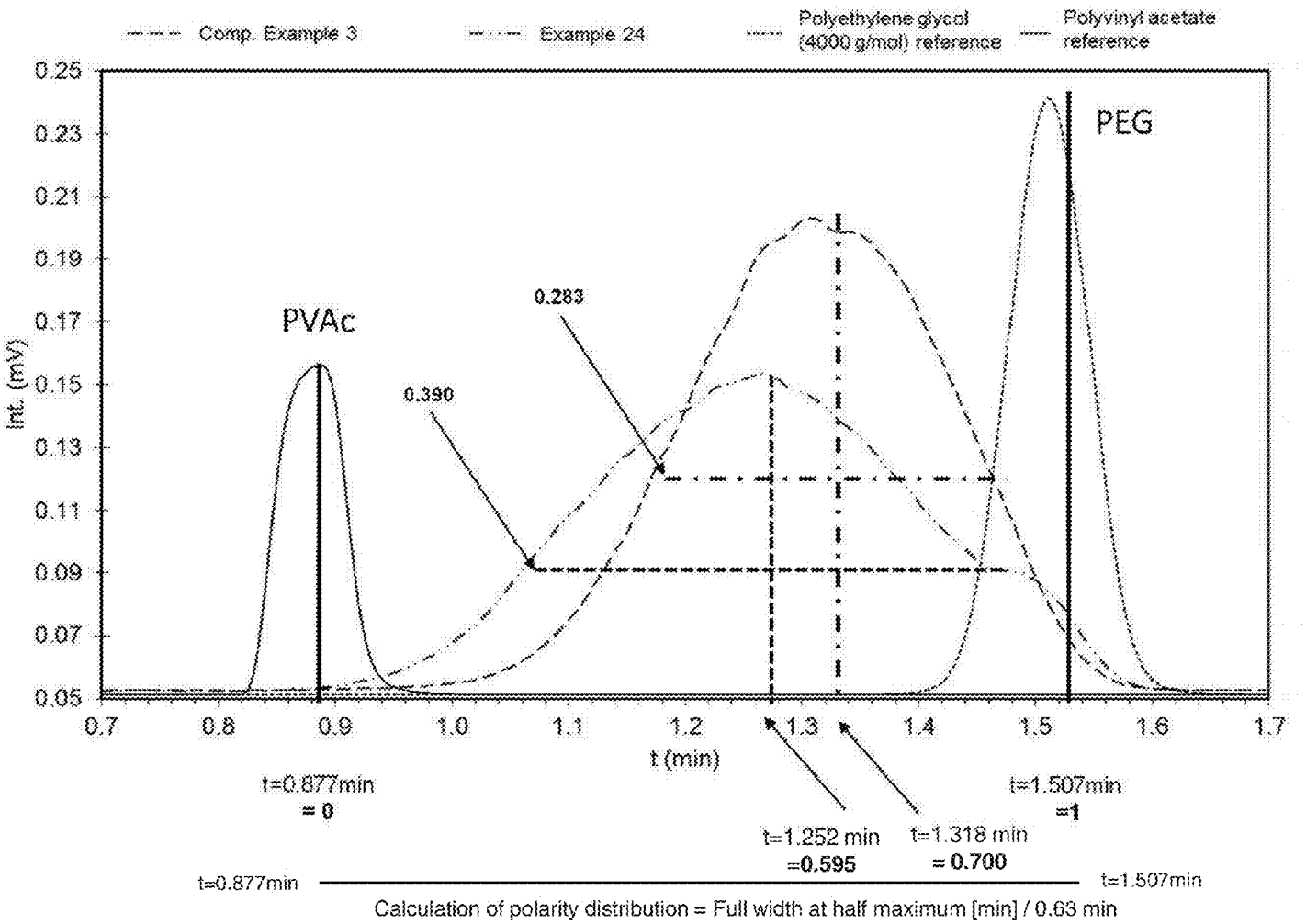
FIG. 8 shows a calculation of polarity distribution.

The present invention relates to a detergent composition comprising an amphiphilic graft polymer based on water-soluble polyalkylene oxides (A) as a graft base and side chains formed by polymerization of a vinyl ester component (B), where the polymer has a mean molar mass ($M_w$) of from 3000 to 100,000 and where the polymer comprises (A) from 15% to 70% by weight of a water-soluble polyalkylene oxide as a graft base and (B) side chains formed by free-radical polymerization of from 30 to 85% by weight of a vinyl ester component composed of (B1) from 70 to 100% by weight of vinyl acetate and/or vinyl propionate and (B2) from 0 to 30% by weight of a further ethylenically unsaturated monomer, where the polymer has a full width at half maximum of the polarity distribution between 0.35 and 1.0.

Graft polymers of polyvinylacetate (PVAc) grafted on polyethylenglycol (PEG) are amphipilic polymers with a polarity depending mainly on the ratio of polyethylenglycol as the hydrophilic part and polyvinylacetate as the hydrophobic part and their amount of individual grafted polymer chains. Higher amounts of vinylacetate in the polymers renders the polymer more apolar, whereas increasing the amount of PEG renders the polymer more polar. This can be controlled by the ratio of PEG and VAc in the polymerization reaction. The distribution of polarity can be assessed by GPEC (gradient polymer elution chromatography). Whereas the polymers prepared according to the state of the art exhibit a narrow polarity distribution, described as a relative to PEG and PVAc as a standard, polymers with the same Polyethylenglycol/Vinylacetate (PEG/VAc) weight ratio that are prepared by the inventive process exhibit a broad distribution of polarity. Furthermore, whereas polymers prepared according to the state of the art exhibit a low polarity, described as $\mu$ relative to PEG and PVAc as a standard, polymers with the same PEG/VAc weight ratio that are prepared by the inventive process exhibit a higher polarity, i.e. they are in total more hydrophilic. A broad distribution of polarity can be advantageous especially when polymers are used in detergent compositions. Graft polymers having broad polarity distributions provide a broader variety of cleaning benefits by treating and/or suspending a broader spectrum of soils. Graft polymers having narrow polarity distributions provide more limited cleaning benefits.

In some aspects, the graft polymer has a full width at half maximum of the polarity distribution between 0.35 and 1.0, in particular between 0.40 and 0.8, alternatively between 0.50 and 0.75. In certain aspects, the graft polymer has a full width at half maximum of the polarity distribution between 0.35 and 1.0 and a maximum of the polarity distribution between 0.45 and 1. In some aspects, the maximum of the polarity distribution is between 0.5 and 0.8.

In certain aspects, the inventive graft polymer has a polarity distribution with a square root $\sigma^2$ greater than 18. In some aspects, the amphiphilic graft polymer has a polarity distribution expressed in % of polyvinylacetate with a square root $\sigma^2$ greater than 20. In particular, the amphiphilic graft polymer has a polarity distribution expressed in % of polyvinylacetate with a square root $\sigma^2$ greater than 20 and a mean value $\mu$ less than 50. In certain aspects, the square root $\sigma^2$ is greater than 20 and the mean value $\mu$ is less than 45. The methods for the determining square root $\sigma^2$ and mean value $\mu$ are described in the examples.

The inventive graft polymers feature a narrow molar mass distribution and hence a polydispersity $M_w/M_n$ of generally $\leq 3$, preferably $\leq 2.8$, more preferably $\leq 2.5$, and even more preferably $\leq 2.3$. Most preferably, their polydispersity $M_w/M_n$ is in the range from 1.5 to 2.2. The polydispersity of the graft polymers can be determined, for example, by gel permeation chromatography using narrow-distribution polymethyl methacrylates as the standard.

The mean molecular weight $M_w$ of the inventive graft polymers is from 3000 to 100,000, preferably from 6000 to 45,000 and more preferably from 8000 to 30,000.

Polyalkylene Oxide (A)

The polyalkylene oxide is preferably water-soluble, wherein water-soluble in the sense of the present invention means a polyalkylene oxide of which at least 50% by weight is soluble in water. In the sense of the present invention, a polyalkylene oxide can be referred to as polyethylene glycol.

Water-soluble polyalkylene oxides suitable for forming the graft base (A) are in principle all polymers based on C2-C4-alkylene oxides which comprise at least 30% by weight, preferably 50% by weight, more preferably at least 60% by weight, even more preferably at least 75% by weight of ethylene oxide in copolymerized form. The polyalkylene oxides (A) preferably have a low polydispersity $M_w/M_n$, preferably $\leq 2.5$, more preferably $\leq 1.5$, even more preferably $\leq 1.3$. The water-soluble polyalkylene oxide (A) has a mean molecular weight $M_n$ from 1,000 to 20,000 g/mol, preferably from 2,000 to 15,000 g/mol, more preferably from 3,000 to 13,000 g/mol and more particularly from 5,000 to 10,000 g/mol or from 3,000 to 9,000 g/mol.

The polyalkylene oxides (A) may be the corresponding polyalkylene glycols in free form, i.e. with OH end groups, but they may also be capped at one or both end groups. Suitable end groups are, for example, C1-C25-alkyl, phenyl, and C1-C14-alkylphenyl groups. Specific examples of particularly suitable polyalkylene oxides (A) include:

(A1) polyethylene glycols which may be capped at one or both end groups, especially by C1-C25-alkyl groups, but are preferably not etherified, and have mean molar masses $M_n$ of preferably from 1500 to 20,000 g/mol, more preferably from 2500 to 15,000 g/mol;

(A2) copolymers of ethylene oxide and propylene oxide and/or butylene oxide with an ethylene oxide content of at least 50% by weight, which may likewise be capped at one or both end groups, especially by C1-C25-alkyl groups, but are preferably not etherified, and have mean molar masses $M_n$ of preferably from 1500 to 20,000 g/mol, more preferably from 2500 to 15,000 g/mol;

(A3) chain-extended products having mean molar masses of, in particular, from 2500 to 20,000, which are obtainable by reacting polyethylene glycols (A1) having mean molar masses $M_n$ of from 200 to 5000 or copolymers (A2) having mean molar masses $M_n$ of from 200 to 5,000 g/mol with C2-C12-dicarboxylic acids or dicarboxylic esters or C6-C18-diisocyanates.

Preferred graft bases (A) are the polyethylene glycols (A1).

In accordance with their low degree of branching, the molar ratio of grafted to ungrafted alkylene oxide units in the inventive graft polymers is from 0.002 to 0.05, preferably from 0.002 to 0.035, more preferably from 0.003 to 0.025 and most preferably from 0.004 to 0.02.

Vinyl Ester Component (B)

The side chains of the inventive graft polymers are formed by polymerization of a vinyl ester component (B) in the presence of the graft base (A).

The vinyl ester component (B) may consist advantageously of (B1) vinyl acetate or vinyl propionate or of mixtures of vinyl acetate and vinyl propionate, particular preference being given to vinyl acetate as the vinyl ester component (B).

The side chains of the graft polymer may also be formed by copolymerizing vinyl acetate and/or vinyl propionate (B1) and a further ethylenically unsaturated monomer (B2). The fraction of monomer (B2) in the vinyl ester component (B) may be up to 30% by weight, which corresponds to a content in the graft polymer of (B2) of 24% by weight.

Suitable comonomers (B2) are, for example, monoethylenically unsaturated carboxylic acids and dicarboxylic acids and their derivatives, such as esters, amides and anhydrides, and styrene. It is of course also possible to use mixtures of different comonomers. For the purpose of this invention the prefix (meth) written before a compound means the respective unsubstituted compound and/or the compound substituted by the methyl group. For instance, "(meth)acrylic acid" means acrylic acid and/or methacrylic acid, (meth)acrylate means acrylate and/or methacrylate, (meth)acrylamide means acrylamide and/or methacrylamide.

Specific examples include: (meth)acrylic acid, C1-C12-alkyl and hydroxy-C2-C12-alkyl esters of (meth)acrylic acid, (meth)acrylamide, N—C1-C12-alkyl(meth)acrylamide, where the alkyl moiety can be branched or linear, N,N di(C1-C6-alkyl)(meth)acrylamide, maleic acid, maleic anhydride and mono(C1-C12-alkyl)esters of maleic acid. Preferred monomers (B2) are the C1-C8-alkyl esters of (meth)acrylic acid and hydroxyethyl acrylate, particular preference being given to the C1-C4-alkyl esters of (meth)acrylic acid. Very particularly preferred monomers (B2) are methyl acrylate, ethyl acrylate, and, in particular, n-butyl acrylate.

When the inventive graft polymers comprise the monomers (B2) as a constituent of the vinyl ester component (B), the content of graft polymers in (B2) is preferably from 0.5 to 20% by weight, more preferably from 1 to 15% by weight and most preferably from 2 to 10% by weight.

The inventive graft polymers also have only a low content of ungrafted polyvinyl ester (B). In general, they comprise ≤10% by weight, preferably ≤7.5% by weight and more preferably ≤5% by weight of ungrafted polyvinyl ester (B).

Owing to the low content of ungrafted polyvinyl ester and the balanced ratio of components (A) and (B), the inventive graft polymers are soluble in water or in water/alcohol mixtures (for example a 25% by weight solution of diethylene glycol monobutyl ether in water). They have pronounced, low cloud points which, for the graft polymers soluble in water at up to 50° C., are generally ≤95° C., preferably ≤85° C. and more preferably ≤75° C., and, for the other graft polymers in 25% by weight diethylene glycol monobutyl ether, generally ≤90° C., preferably from 45 to 85° C.

In some embodiments, the graft polymers of the invention comprise from 25 to 60% by weight of the graft base (A) and from 40 to 75% by weight of the polyvinyl ester component (B).

In FIG. 1, the molecular weight distribution determined by size exclusion chromatography is shown. In the case where a nonionic surfactant is used as an additive, this can be seen as one peak in the range of 1000-3000 g/mol. The graft polymer can be seen at higher molecular weight.

Process of Making Amphiphilic Graft Polymers

The inventive graft polymers are obtained by a continuous process wherein a vinyl ester component (B) composed of vinyl acetate and/or vinyl propionate (B1) and, if desired, a further ethylenically unsaturated monomer (B2), is polymerized in the presence of a polyalkylene oxide (A), a free radical-forming initiator (C) and, if desired, an additive (D), at a mean polymerization temperature at which the initiator (C) has a decomposition half-time of from 1 to 500 min, in at least one tubular reactor segment with a feed side and an outlet side, through which the reaction mixture comprising at least a part of component (A) to (C), and if desired (D), streams. In a preferred embodiment of the continuous process, the polymerization time is up to 2 hours.

Preferably, in the process according to the invention the local steady-state concentration of radicals present at the mean polymerization temperature is substantially constant over time and the graft monomer (B) is present in the reaction mixture or the stream constantly in low concentration (for example of not more than 5% by weight). This allows the reaction to be controlled, and graft polymers can be prepared in a controlled manner with the desired low degree of grafting and the desired low polydispersity. The term "mean polymerization temperature" is intended to mean here that, although the process is substantially isothermal, there may, owing to the exothermicity of the reaction, be temperature variations which are preferably kept within the range of +/−10° C., more preferably in the range of +/−5° C. In another form, the process can be run adiabatically where the heat of polymerization is used to heat the reaction mixture to a desired reaction temperature.

According to the invention, the free radical-forming initiator (C) at the mean polymerization temperature should have a decomposition half-life of from 2 to 500 min, preferably from 6 to 300 min and more preferably from 8 to 150 min. Preferably the mean polymerization temperature is appropriately in the range from 50 to 160° C., in particular from 60 to 140° C. and especially from 65 to 110° C.

Examples of suitable initiators (C) whose decomposition half-life in the temperature range from 50 to 160° C. is from 2 to 500 min are:

Tert-C4-C12 hydroperoxides, such as cumyl hydroperoxide, tert-amyl hydroperoxide, tert-butyl hydroperoxide, 2,5-dimethyl-2,5-di-(hydroperoxy)-hexan and 1,1,3,3-tetramethylbutyl hydroperoxide.

C4-C12 dialkyl peroxides, such as dicumyl peroxide, 2,5-di(tert-butylperoxy)-2,5-dimethylhexane, tert-butyl cumyl peroxide, alfa,alfa-bis(tert-butylperoxy)diisopropylbenzene, di(tert-amyl)peroxide, di(tert-butyl) peroxide, 2,5-di(tert-butylperoxy)-2,5-dimethyl-3-hexyne, C4-C12 ketone peroxides, such as methyl ethyl ketone peroxide, methyl isopropyl ketone peroxide, cyclohexanone peroxide, acetylacetone peroxide and methyl isobutyl ketone peroxide.

C4-C12 diperoxyketals, such as butyl 4,4-di(tert-butylperoxy)valerate, 1,1-di(tert-butylperoxy)cyclohexane, ethyl 3,3-di(tert-amylperoxy) butanoate, tert-butyl peroxy-2-ethylhexanoate, ethyl 3,3-di(tert-butylperoxy) butyrate, 1,1-di(tert-butylperoxy)-cyclohexane, 1,2-di (tert-butylperoxy)-3,3,5-tri¬methy¬cyclo-hexane and 2,2-di(tert-butylperoxy)butane O—C2-C12-acylated derivatives of tert-C4-C12-alkyl hydroperoxides and tert-(C6-C12-aralkyl)hydroperoxides, such as tert-amyl peroxyacetate, tert-butyl peroxyacetate, tert-butyl monoperoxy-maleate, tert-butyl peroxyisobutyrate, tert-butyl peroxypivalate, tert-butyl peroxyneoheptanoate, tert-butyl peroxy-2-ethylhexanoate, tert-butyl peroxy-3,5,5-trimethylhexanoate, tert-butyl peroxyneodecanoate, tert-amyl peroxypivalate, tert-amyl peroxy-2-ethylhexanoate, tert-amyl peroxyneodecanoate, 1,1,3,3-tetramethylbutyl peroxyneodecanoate, cumyl peroxyneodecanoate, 3-hydroxy-1,1-dimethylbutyl peroxyneodecanoate, tert-butyl peroxybenzoate, 2,5-di(2-ethylhexanoylperoxy)-2,5-dimethylhexane, tert-amyl peroxybenzoate and di-tert-butyl diperoxyphthalate;

di-O—C4-C12-acylated derivatives of tert-C8-C10-alkylene bisperoxides, such as 2,5-dimethyl-2,5-di(2-ethylhexanoylperoxy)hexane, 2,5-dimethyl-2,5-di(benzoylperoxy)hexane and 1,3-di(2-neodecanoylperoxyisopropyl)benzene; di(C2-C12-alkanoyl) and dibenzoyl peroxides, such as diacetyl peroxide, dipropionyl peroxide, disuccinic acid peroxide, dicapryloyl peroxide, di(3,5,5-trimethylhexanoyl) peroxide, didecanoyl peroxide, dilauroyl peroxide, dibenzoyl peroxide, di(4-methylbenzoyl)peroxide, di(4-chlorobenzoyl)peroxide and di(2,4-dichlorobenzoyl)peroxide;

tert-C4-C5-alkyl peroxy(C4-C12-alkyl)carbonates, such as tert-amyl per-oxy(2-ethylhexyl)carbonate, tert-butyl peroxy(isopropyl)carbonate and tert-butyl peroxy(2-ethylhexyl)carbonate and polyether polytert-butyl peroxy carbonate; di(C2-C12-alkyl)peroxydicarbonates, such as di(n-propyl)peroxydicarbonate, di(n-butyl)peroxydicarbonate, di(sec-butyl)peroxydicarbonate and di(2-ethylhexyl)peroxydicarbonate azo compounds such as 2,2'-azobisisobutyronitrile (AIBN), 2,2'-azobis(2-methylbutyronitrile), 2,2'-azobis[2-methyl-N-(2-hydroxyethyl)propionamide], 1,1'-azobis(1-cyclohexanecarbonitrile), 2,2'-azobis(2,4-dimethylvaleronitrile), 2,2'-azobis(N,N'-dimethyleneisobutyroamidine), 2,2'-azobis-(N,N'-dimethyleneisobutyroamidine), 2,2'-azobis(2-methylpropioamidine), N-(3-hydroxy-1,1-bis(hydroxymethyl)propyl)-2-[1-(3-hydroxy-1,1-bis-(hydroxymethyl)propylcarbamoyl)-1-methylethylazo]-2-methylpropionamide and N-(1-ethyl-3-hydroxypropyl)-2-[1-(1-ethyl-3-hydroxypropylcarbamoyl)-1-methyl-ethylazo]-2-methylpropionamide; 2,2'-azobis(2-cyano-2-butane), dimethyl-2,2'-azobisdimethyl isobutyrate, 4,4'-azobis(4-cyanopentanoic acid), 1,1'-azobis(cyclohexanecarbanitrile), 2-(tert-butylazo)-2-cyanopropane, 2,2'-azobis[2-methyl-N-(1,1)-bis(hydroxymethyl)-2-hydroxyethyl]propionamide, 2,2'-azobis[2-methyl-N-hydroxyethyl)]propionamide, 2,2'-azobis(N,N'-dimethylene-isobutyramidine)dihydrochloride, 2,2'-azobis(2-amidinopropane)dihydrochloride, 2,2'-azobis(N,N'-dimethyleneisobutyramine), 2,2'-azobis(2-methyl-N-[1,1-bis(hydroxymethyl)-2-hydroxyethyl]propionamide), 2,2'-azobis(2-methyl-N-[1,1-bis(hydroxymethyl)ethyl]propionamide), 2,2'-azobis[2-methyl-N-(2-hydroxyethyl)propionamide], 2,2'-azobis(isobutyramide)dihydrate, 2,2'-azobis(2,2,4-trimethylpentane), 2,2'-azobis(2-methylpropane)

redox initiators: this is understood to mean initiator systems which comprise an oxidizing agent, for example a salt of peroxodisulfuric acid, hydrogen per-oxide or an organic peroxide such as tert-butyl hydroperoxide, and a reducing agent. As the reducing agent, they preferably comprise a sulfur compound which is especially selected from sodium hydrogensulfite, sodium hydroxymethanesulfinate and the hydrogensulfite adduct to acetone. Further suitable reducing agents are nitrogen and phosphorus compounds such as phosphorous acid, hypophosphites and phosphinates, di-tert-butyl hyponitrite and dicumyl hyponitrite, and also hydrazine and hydrazine hydrate and ascorbic acid. In addition, redox initiator systems may comprise an addition of small amounts of redox metal salts such as iron salts, vanadium salts, copper salts, chromium salts or manganese salts, for example the ascorbic acid/iron (II) sulfate/sodium peroxodisulfate redox initiator system.

The abovementioned initiators can also be used in any combinations. The initiators can be used as such or dissolved in a solvent. Preference is given to using the initiators dissolved in a suitable solvent.

Preferred initiators (C) are O—C4-C12-acylated derivatives of tert-C4-C5-alkyl hydroperoxides, tert-Butyl hydroperoxide or di-tert-Butyl hydroperoxides, particular preference being given to tert-butyl peroxypivalate and tert-butyl peroxy-2-ethylhexanoate. Further preferred initiatiors that are especially suited for temperatures above 120° C. are tert-butyl peroxybenzoate, di-cumylperoxid, di-tert-butyl peroxide, especially preferred di-tert-butyl peroxide.

The inventive polymerization reaction can be carried out in the presence of an additive (D). The additive is selected from the group consisting of surfactants, e.g., nonionic surfactant, solvents, diluents, fillers, colorants, rheology modifiers, crosslinkers or emulsifiers or mixtures thereof. In particular, additives are solvents, which are also used to formulate the inventive graft polymers for use and can therefore remain in the polymerization product. Preference is given to using water-soluble or water-miscible solvents. Examples of suitable solvents (D) include: monohydric alcohols, preferably aliphatic C1-C16-alcohols, more preferably aliphatic C2-C12-alcohols, most preferably C2-C4-alcohols, such as ethanol, propanol, iso-propanol, butanol, sec-butanol and tert-butanol; polyhydric alcohols, preferably C2-C10-diols, more preferably C2-C6-diols, most preferably C2-C4-alkylene glycols, such as ethylene glycol and propylene glycol; alkylene glycol ethers, preferably alkylene glycol mono(C1-C12-alkyl)ethers and alkylene glycol di(C1-C6-alkyl)ethers, more preferably alkylene glycol mono- and di(C1-C2-alkyl) ethers, most preferably alkylene glycol mono(C1-C2-alkyl) ethers, such as ethylene glycol monomethyl and -ethyl ether and propylene glycol mono-methyl and -ethyl ether; polyalkylene glycols, preferably poly(C2-C4-alkylene)glycols having 2-20 C2-C4-alkylene glycol units, more preferably polyethylene glycols having 2-20 ethylene glycol units and polypropylene glycols having 2-10 propylene glycol units, most preferably polyethylene glycols having 2-15 ethylene glycol units and polypropylene glycols having 2-4 propylene glycol units, such as diethylene glycol, triethylene glycol, dipropylene glycol and tripropylene glycol; polyalkylene glycol monoethers, preferably poly(C2-C4-alkylene)glycol mono(C1-C25-alkyl)ethers having 2-20 alkylene glycol units, more preferably poly(C2-C4-alkylene)glycol mono (C1-C2o-alkyl) ethers having 2-20 alkylene glycol units, most preferably poly(C2-C3-alkylene)glycol mono(C1-C16-alkyl)ethers having 3-20 alkylene glycol units; carboxylic esters, preferably C1-C8-alkyl esters of C1-C6-carboxylic acids, more preferably C1-C4-alkyl esters of C1-C3-carboxylic acids, most preferably C2-C4-alkyl esters of C2-C3-carboxylic acids, such as ethyl acetate and ethyl propionate; aliphatic ketones which preferably have from 3 to 10 carbon atoms, such as acetone, methyl ethyl ketone, diethyl ketone and cyclohexanone; cyclic ethers, in particular tetrahydrofuran and dioxane.

Preferred examples of these solvents are polyethylene glycols having 2-15 ethylene glycol units, polypropylene glycols having 2-6 propylene glycol units and in particular alkoxylation products of C6-C16-alcohols (alkylene glycol monoalkyl ethers and polyalkylene glycol monoalkyl ethers).

The polymerization is preferably effected under pressure so that all the components are in liquid form, especially component B, whereby the pressure ranges from 2 to 200 bar, preferably from 3 to 100 bar or can be effected under standard pressure or at reduced or elevated pressure. When the boiling point of the monomers (B) or of any additive (D) used, is exceeded at the selected pressure, the polymerization is carried out with cooling.

In certain aspects of the invention, 15 to 85% by weight of a vinyl ester component (B), composed of 70 to 100% by weight of vinyl acetate and/or vinyl propionate (B1) and 0 to 30% by weight of the further ethylenically unsaturated monomer (B2), 15 to 70% by weight of the polyalkylene oxide (A) of mean molecular mass $M_n$ of from 1000 to 20,000 g/mol, 0.1 to 3% by weight, based on compound (B), of the free radical-forming initiator (C) and 0 to 40% by weight, based on the sum of the components (A), (B) and (C), of an additive (D), are used, whereby the sum of which is in total 100%.

In particular aspects, 20 to 70%, by weight of the vinyl ester component (B), 25 to 60% by weight of a water-soluble polyalkylene oxide (A) of mean molecular mass $M_n$ of from 1000 to 20,000 g/mol, 0.2 to 2.5% by weight based on component (B), of the free-radical forming initiator (C) and 0 to 30% by weight, based on the sum of the components (A), (B) and (C) of an additive, are used, whereby the sum of which is in total 100%.

Laundry Detergents and Cleaning Compositions

The inventive laundry detergents and cleaning compositions of the present invention comprise generally from 0.05 to 10% by weight, preferably from 0.1 to 5% by weight and more preferably from 0.25 to 2.5% by weight, based on the particular overall composition, of the amphiphilic graft polymers of the present invention.

In addition, the laundry detergents and cleaning compositions generally comprise surfactants and, if appropriate, other polymers as washing substances, builders and further customary ingredients, for example cobuilders, complexing agents, bleaches, standardizers, graying inhibitors, dye transfer inhibitors, enzymes and perfumes.

The amphiphilic graft polymers of the present invention may be utilized in laundry detergents or cleaning compositions comprising a surfactant system comprising $C_{10}$-$C_{15}$ alkyl benzene sulfonates (LAS) and one or more co-surfactants selected from nonionic, cationic, anionic or mixtures thereof. The selection of co-surfactant may be dependent upon the desired benefit. In one embodiment, the co-surfactant is selected as a nonionic surfactant, preferably $C_{12}$-$C_{18}$ alkyl ethoxylates. In another embodiment, the co-surfactant is selected as an anionic surfactant, preferably $C_{10}$-$C_{18}$ alkyl alkoxy sulfates ($AE_xS$) wherein x is from 1-30. In another embodiment the co-surfactant is selected as a cationic surfactant, preferably dimethyl hydroxyethyl lauryl ammonium chloride. If the surfactant system comprises $C_{10}$-$C_{15}$ alkyl benzene sulfonates (LAS), the LAS is used at levels ranging from about 9% to about 25%, or from about 13% to about 25%, or from about 15% to about 23% by weight of the composition.

The surfactant system may comprise from 0% to about 7%, or from about 0.1% to about 5%, or from about 1% to about 4% by weight of the composition of a co-surfactant selected from a nonionic co-surfactant, cationic co-surfactant, anionic co-surfactant and any mixture thereof.

Non-limiting examples of nonionic co-surfactants include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1-30, as discussed in U.S. Pat. Nos. 6,153,577, 6,020,303 and 6,093,856; Alkylpolysaccharides as discussed in U.S. Pat. No. 4,565,647 Llenado, issued Jan. 26, 1986; specifically alkylpolyglycosides as discussed in U.S. Pat. Nos. 4,483,780 and 4,483,779; Polyhydroxy fatty acid amides as discussed in U.S. Pat. No. 5,332,528; and ether capped poly(oxyalkylated) alcohol surfactants as discussed in U.S. Pat. No. 6,482,994 and WO 01/42408.

Non-limiting examples of semi-polar nonionic co-surfactants include: water-soluble amine oxides containing one alkyl moiety of from about 10 to about 18 carbon atoms and 2 moieties selected from the group consisting of alkyl moieties and hydroxyalkyl moieties containing from about 1 to about 3 carbon atoms; water-soluble phosphine oxides containing one alkyl moiety of from about 10 to about 18 carbon atoms and 2 moieties selected from the group consisting of alkyl moieties and hydroxyalkyl moieties containing from about 1 to about 3 carbon atoms; and water-soluble sulfoxides containing one alkyl moiety of from about 10 to about 18 carbon atoms and a moiety selected from the group consisting of alkyl moieties and hydroxyalkyl moieties of from about 1 to about 3 carbon atoms. See WO 01/32816, U.S. Pat. Nos. 4,681,704, and 4,133,779.

Non-limiting examples of cationic co-surfactants include: the quaternary ammonium surfactants, which can have up to 26 carbon atoms include: alkoxylate quaternary ammonium (AQA) surfactants as discussed in U.S. Pat. No. 6,136,769; dimethyl hydroxyethyl quaternary ammonium as discussed in U.S. Pat. No. 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and 6,022,844; and amino surfactants as discussed in U.S. Pat. No. 6,221,825 and WO 00/47708, specifically amido propyldimethyl amine (APA).

Nonlimiting examples of anionic co-surfactants useful herein include: $C_{10}$-$C_{20}$ primary, branched chain and random alkyl sulfates (AS); $C_{10}$-$C_{18}$ secondary (2,3) alkyl sulfates; $C_{10}$-$C_{18}$ alkyl alkoxy sulfates ($AE_xS$) wherein x is from 1-30; $C_{10}$-$C_{18}$ alkyl alkoxy carboxylates comprising 1-5 ethoxy units; mid-chain branched alkyl sulfates as discussed in U.S. Pat. Nos. 6,020,303 and 6,060,443; mid-chain branched alkyl alkoxy sulfates as discussed in U.S. Pat. Nos. 6,008,181 and 6,020,303; modified alkylbenzene sulfonate (MLAS) as discussed in WO 99/05243, WO 99/05242 and WO 99/05244; methyl ester sulfonate (MES); and alpha-olefin sulfonate (AOS).

The present invention may also relates to compositions comprising the inventive amphiphilic graft polymers and a surfactant system comprising $C_8$-$C_{18}$ linear alkyl sulphonate surfactant and a co-surfactant. The compositions can be in any form, namely, in the form of a liquid; a solid such as a powder, granules, agglomerate, paste, tablet, pouches, bar, gel; an emulsion; types delivered in dual-compartment containers; a spray or foam detergent; premoistened wipes (i.e., the cleaning composition in combination with a nonwoven material such as that discussed in U.S. Pat. No. 6,121,165, Mackey, et al.); dry wipes (i.e., the cleaning composition in combination with a nonwoven materials, such as that discussed in U.S. Pat. No. 5,980,931, Fowler, et al.) activated with water by a consumer; and other homogeneous or multiphase consumer cleaning product forms.

In one embodiment, the cleaning composition of the present invention is a liquid or solid laundry detergent composition. In another embodiment, the cleaning composition of the present invention is a hard surface cleaning composition, preferably wherein the hard surface cleaning composition impregnates a nonwoven substrate. As used herein "impregnate" means that the hard surface cleaning composition is placed in contact with a nonwoven substrate such that at least a portion of the nonwoven substrate is penetrated by the hard surface cleaning composition, preferably the hard surface cleaning composition saturates the nonwoven substrate. The cleaning composition may also be utilized in car care compositions, for cleaning various surfaces such as hard wood, tile, ceramic, plastic, leather, metal, glass. This cleaning composition could be also designed to be used in a personal care and pet care compositions such as shampoo composition, body wash, liquid or solid soap and other cleaning composition in which surfactant comes into contact with free hardness and in all compositions that require hardness tolerant surfactant system, such as oil drilling compositions.

In another embodiment the cleaning composition is a dish cleaning composition, such as liquid hand dishwashing compositions, solid automatic dishwashing compositions, liquid automatic dishwashing compositions, and tab/unit does forms of automatic dishwashing compositions.

Quite typically, cleaning compositions herein such as laundry detergents, laundry detergent additives, hard surface cleaners, synthetic and soap-based laundry bars, fabric softeners and fabric treatment liquids, solids and treatment articles of all kinds will require several adjuncts, though certain simply formulated products, such as bleach additives, may require only, for example, an oxygen bleaching agent and a surfactant as described herein. A comprehensive list of suitable laundry or cleaning adjunct materials can be found in WO 99/05242.

Common cleaning adjuncts include builders, enzymes, polymers not discussed above, bleaches, bleach activators, catalytic materials and the like excluding any materials already defined hereinabove. Other cleaning adjuncts herein can include suds boosters, suds suppressors (antifoams) and the like, diverse active ingredients or specialized materials such as dispersant polymers (e.g., from BASF Corp. or Rohm & Haas) other than those described above, color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents, chelating agents, dye transfer inhibiting agents, dispersants, brighteners, suds suppressors, dyes, structure elasticizing agents, fabric softeners, anti-abrasion agents, hydrotropes, processing aids, and other fabric care agents, surface and skin care agents. Suitable examples of such other cleaning adjuncts and levels of use are found in U.S. Pat. Nos. 5,576,282, 6,306,812 B1 and 6,326,348 B1.

Method of Use

The present invention includes a method for cleaning a targeted surface. As used herein "targeted surface" may include such surfaces such as fabric, dishes, glasses, and other cooking surfaces, hard surfaces, hair or skin. As used herein "hard surface" includes hard surfaces being found in a typical home such as hard wood, tile, ceramic, plastic, leather, metal, glass. Such method includes the steps of contacting the composition comprising the modified polyol compound, in neat form or diluted in wash liquor, with at least a portion of a targeted surface then optionally rinsing the targeted surface. Preferably the targeted surface is subjected to a washing step prior to the aforementioned optional rinsing step. For purposes of the present invention, washing includes, but is not limited to, scrubbing, wiping and mechanical agitation.

As will be appreciated by one skilled in the art, the cleaning compositions of the present invention are ideally suited for use in home care (hard surface cleaning compositions) and/or laundry applications.

The composition solution pH is chosen to be the most complimentary to a target surface to be cleaned spanning broad range of pH, from about 5 to about 11. For personal care such as skin and hair cleaning pH of such composition preferably has a pH from about 5 to about 8 for laundry cleaning compositions pH of from about 8 to about 10. The compositions are preferably employed at concentrations of from about 200 ppm to about 10,000 ppm in solution. The water temperatures preferably range from about 5° C. to about 100° C.

For use in laundry cleaning compositions, the compositions are preferably employed at concentrations from about 200 ppm to about 10000 ppm in solution (or wash liquor). The water temperatures preferably range from about 5° C. to about 60° C. The water to fabric ratio is preferably from about 1:1 to about 20:1.

The method may include the step of contacting a nonwoven substrate impregnated with an embodiment of the composition of the present invention As used herein "nonwoven substrate" can comprise any conventionally fashioned nonwoven sheet or web having suitable basis weight, caliper (thickness), absorbency and strength characteristics. Examples of suitable commercially available nonwoven substrates include those marketed under the tradename SONTARA® by DuPont and POLYWEB® by James River Corp.

As will be appreciated by one skilled in the art, the cleaning compositions of the present invention are ideally suited for use in liquid dish cleaning compositions. The method for using a liquid dish composition of the present invention comprises the steps of contacting soiled dishes with an effective amount, typically from about 0.5 ml. to about 20 ml. (per 25 dishes being treated) of the liquid dish cleaning composition of the present invention diluted in water.

Test Methods

GPC

Gel Permeation Chromatography (GPC): Polymer dispersity is determined by size exclusion chromatography (SEC) using a SEC column set from MZ Analysentechnik (Mainz, Germany) (column type MZ-Gel SD Plus, highly cross-linked styrene/divinylbenzene copolymer, particle size 5 μm; (1st column: L: 300 mm, ID: 8 mm, Porosity: 100 Å; 2nd column: L: 300 mm; ID: 8 mm, Porosity: 10e3 Å; 3rd column: L: 300 mm; ID: 8 mm; Porosity: 10e5 Å; 4th column: L: 300 mm, ID: 8 mm, Porosity: 10e6 Å)); eluent: tetrahydrofuran, flow rate: 1.00 ml/min; injection volume: 100,000 μl, column temperature: 35° C.; sample concentrations in the range of 0.1-0.2 wt %, calibrated by using polystyrene standards from Polymer Standards Service (Mainz, Germany) in the range from 374 g/mol to 2,180,000 g/mol, WINGPC from Polymer Standards Service (Mainz, Germany) was used for calibration.

GPEC

Gradient Polymer Elution Chromatography (GPEC): Test solutions were prepared by dissolving polymer samples in tetrahydrofuran (THF) with a concentration of 10 g/l. Of the solution, 2 μl were injected in the HPLC measurement device. The separation was done using a Waters XBridge Hilic HPLC column with dimensions of 4.6×50 mm and a particle size of 2.5 μm. The eluent starting conditions were 100% acetonitrile (ACN), after 0.3 ml the composition was changed linear to a composition of 60%/40% water/acetonitrile within 5.7 ml. Subsequently, the composition was changed to 95%/5% water/acetonitrile within 0.3 ml. The chromatographic column was rinsed using 1.5 ml of the last mentioned eluent composition and reset within 0.3 ml to initial condition. The volumetric flow was 3 ml/min and the column temperature was 80° C. For detection, an evaporative light scattering detector (ELSD, type PL-ELS 2100 by Polymer Laboratories GmbH, Darmstadt) was used (ELSD conditions: blue LED wavelength=480 nm, evaporation temperature=85° C., nebulizer temperature=50° C., gas flow=1.5 SLM (standard liter per minute)).

TABLE 1

Column: Waters XBridge Hilic; i.D. 4.6 mm; length 50 mm; column temperature: 80° C., flow rate: 3 ml/min; injection volume: 2 ml; concentration: 10 mg/ml; gradient.

| Volume | $H_2O$ by weight | ACN by weight | Time in min |
|---|---|---|---|
| 0.15 | 0 | 100 | 0 |
| 0.45 | 0 | 100 | 0.1 |
| 6.15 | 60 | 40 | 2 |
| 6.25 | 95 | 5 | 2.033 |

As reference materials, polyethylene glycol (molecular weight $M_n$=6000 g/mol, available as Pluriol® E 6000 from BASF SE), and polyvinylacetate (molecular weight 50 000 g/mol, available from Alfa Aesar Company (Polyvinyl acetate M.W. ca 50 000, order number A12732, lot-number 10163914) were used. Care is taken that the molecular weight of the polyethylene glycol reference is the same as that of the polyethylene glycol used as the graft base (compound A) for the synthesis of the amphiphilic graft polymer.

The relative polarity and the polarity distribution of the amphiphilic graft polymer may be determined by analyzing the GPEC signals of the graft polymer sample as well as the GPEC signals of polyethylene glycol and polyvinylacetate, as reference compounds. The quantification of the polarity of the product is performed by analyzing the results from the GPEC chromatograms, either considering them as non-normal distributions (Modern Engineering Statistics, Thomas P. Ryan, Wiley-Interscience, John Wiley & Sons, Inc., Hoboken, N.J., 2007) or taking the maximum of the polarity distribution and the full width at half maximum of the polarity distribution. Two homopolymers were used as reference to convert these chromatograms into a polarity distribution expressed in % of polyvinylacetate. That means that $\mu$ is 0, when polyvinylacetate is 0 and $\mu$ is 1, when polyethyleneglycol is 1.

To describe the shape of the distribution of the polymers' polarity, the second central moment, $\sigma^2$, and its mean value, $\mu$, were calculated. The square root of $\sigma^2$ is the analogue of the standard deviation for a continuous univariate probability distribution. By comparing the value of $\sigma$ for the different graft polymer samples, a measure of the width, or spread, around the expected value $\mu$ of the polarity can be obtained.

Another possible way to analyze the data of the polarity measurement, i.e. to transform the results obtained by the GPEC method into numeric results, would be to use the ratio of broadness and height, meaning the full width at half maximum of the polarity distribution divided by the peak height at the maximum of the polarity distribution. As explained before, this would be compared to the references and the maximum broadness between the two homopolymer references to normalize the results.

Method to Determine Whiteness Maintenance and Results (Obtained with Micro Method): this describes the procedure to evaluate whiteness maintenance due to prevention of redeposition of soils on clean fabrics through the wash.

All components are prepared as stock solutions and combined into final wash solutions each of 10 ml vials. The then prepared wash solutions are transferred to a 96 well micro titre plate (150 micro liter per well). 8 wells are filled per vial and internal replicates are randomly distributed across the plate (MTP). 12 products with 8 replicates each are tested per well plate. Each plate contains a pre-wetted fabric which is placed onto the well plate and sealed with a silicone rubber. 9 small ball bearings are placed into each well and are then magnetically agitated at 20 rpm to provide mechanical stress during wash time. Experiment is repeated for 2 different fabrics (Polyester 854 pre-washed and pre-treated with FE, Emperical Manufacturing Co, Knitted Cotton pre-washed). Each with two different soil compositions (Oil/Carbon Black, Clay/Oil). The fabric is cut in shape to fit the MTP and prior to use it is positioned in a glass with demineralised water where is can soak in water for approx. 30 min. Then the fabric is removed and placed between two layers of paper towel. The excess of water is squeezed out of the fabric with a roll to leave the fabric moist/wet, but not dripping. This pre-wetting step of the fabric is important to avoid that the wash solution is soaked into the fabric by capillary forces during the test. Wash time is 60 mins for clay/oil mix and 30 min for carbon black/oil mix at room temperature. After the wash fabrics are dried at room temperature on a flat metal grid. Once dry each fabric is measured at every treated spot using a Spectrolino colour measurement instrument to determine the delta whiteness index relative to the reference sample.

The final wash solution is made from a combination of a detergent stock solution, a hardness solution, a technology stock solution, a soil stock solution consisting of either a clay/oil or carbon black soil composition (see definition below). The final wash solutions contain a detergent concentration of 3500 ppm, 3.4 mMol hardness (3:1 Ca:Mg, 20 US gpg), 35 ppm polymer concentration, 1500 ppm clay & 1000 ppm oil mix or 500 ppm carbon black and 1000 ppm oil mix concentration in each 150 micro liter well.

Clay defined as Arizona Test Dust (0-3) purchased from Powder Technology Inc. Carbon Black 1333-84-4 purchased from Fisher Chemical. Oil Mix defined as (12% artificial bodysoil, 12% cooking oil, 76% propylene glycol), artificial body soil composition defined as (Palm Kernel Fatty Acid 15%, Oleic Acid 15% Paraffin Oil 15%, Olive Oil 15%, Soja Oil 15%, Squalene 5%, Cholesterol (95%) 5%, Myristic Acid (95%) 5%, Palmitic Acid (95%) 5%, Stearic Acid (90%+) 5%.

Pre-wash of fabrics "without FE (meaning no fabric enhancer)"; 400 g fabrics are washed in a WE Miniwasher (3.5 liter water), ×2 short program, 60° C. with 18.6 g Ariel Compact powder detergent, ×2 short program, 60° C. nil detergent, dry in tumble dryer. Pre-wash of fabrics "pre-treated FE"; 400 g fabrics are washed in a WE Miniwasher (3.5 liter water), ×2 short program, 60° C. with 18.6 g Ariel Compact powder detergent, ×2, ×3 short program, 60° C. nil detergent, ×3 short program, 40° C. with 8.2 g Lenor Concentrate into each main wash, ×1 short program, 40° C. with 8.2 g Lenor Concentrate into last rinse. Dried in tumble dryer.

Examples

Materials

Additive D1: Nonionic (NIO) surfactant 1: alkoxylated singly-branched C10-guerbet alcohol, cloud point approx. 80° C. (measured according to EN 1890, method A), available as Lutensol XL100

Additive D2: NIO surfactant 2: alkoxylated singly-branched C10-guerbet alcohol, cloud point approx. 71° C. (measured according to EN 1890, method D), available as Lutensol XL70

Additive D3: NIO surfactant 3: alkoxylated singly-branched C10-guerbet alcohol, cloud point approx. 60° C. (measured according to EN 1890, method E), available as Lutensol XL50

Polyalkylene glykol A: PEG 6000, polyethylene glycol with molecular weight of Mn 6000 g/mol, available for example as Pluriol® E6000.

Initiator C: tert.-Butylperoxy-2-ethylhexanoate: for example available as "Trigonox 21 S" from Akzo Nobel The eight tubular reactor segments denoted as 2-2*g* were used to run the polymerization. The void volume of the tubular reactor segments 2-2*c* is 45 ml each and that of the tubular reactor segments 2*d*-2*g* is 130 ml. Each of the tubular reactor segments 2-2*g* is 50 cm long and the inner diameter of the tubular reactor segments 2-2*c* is 1.2 cm and that of the tubular reactor segments 2*d*-2*g* is 2.3 cm. These tubular reactor segments are filled with SMX static mixers from the company Fluitec and they have 'inlet' denoted as the feed side and 'outlet' denoted as outlet side. The pumps used in this setup were micro annular gear pumps, supplied by company HNP Mikrosysteme GmbH.

These tubular reactor segments have been operated in series, where the outlet of tubular reactor segment 2 is connected to the feed side of the segment 2*a*.

Example 1

To the feed side of the tubular reactor segment 2 a stream composed of a mixture of 172 g/h of PEG 6000 (component A), 27.1 g/h of Lutensol® XL 100 (component D) at 85° C. and 64.5 g/h of vinyl acetate (component B) at room temperature were fed. A stream of the outlet side of the tubular reactor segment 2*c* was recycled back with a gear pump to the feed side of the tubular reactor segment 2 at a rate of 4500 g/h. A stream of 9.6 g/h of a 25 wt % of Trigonox® 21 S solution in tripropylene glycol (component C) at room temperature were fed in this recycle stream directly before the gear pump (at the suction side). The temperature of the tubular reactor segments 2-2*c* was 92° C. A stream of the outlet side of the tubular reactor segment 2*d* was recycled back with a gear pump to a dynamic mixer connected to the feed side of 2*d* at a rate of 4500 g/h (the recycled stream enters the gear pump→dynamic mixer→feed seed of 2*d*). A stream of 64.5 g/h of vinyl acetate (component B) at room temperature was fed in this recycled stream directly before the gear pump (at the suction side). The temperature of the tubular reactor segment 2*d* was 91° C. A stream of the outlet side of the tubular reactor segment 2*e* was recycled back with a gear pump to a dynamic mixer connected to the feed side of 2*e* at a rate of 4500 g/h recycle stream enters the gear pump→dynamic mixer→feed seed of 2*e*). A stream of 64.5 g/h of vinyl acetate (component B) at room temperature was fed in this recycle stream directly before the gear pump (at the suction side). The temperature of the tubular reactor segment 2*e* was 90.5° C. A stream of the outlet side of the tubular reactor segment 2*f* was recycled back with a gear pump to a dynamic mixer connected to the feed side of 2*e* at a rate of 4500 g/h (the recycled stream enters the gear pump→dynamic mixer→feed seed of 2*f*). A stream of 64.5 g/h of vinyl acetate (component B) at room temperature was fed in this recycled stream directly before the gear pump (at the suction side). The temperature of 2*f* was 90.5° C. To the feed side of the tubular reactor segment 2*g* a stream of 9.6 g/h of a 25 wt % of Trigonox® 21 S solution in tripropylene glycol (component C) at room temperature was fed. The temperature of the tubular reactor segment 2*g* was 100° C. and the pressure at the outlet side of 2*g* was regulated by a pressure regulation bar and kept constant at 8 bar.

Example 2

To the feed side of the tubular reactor segment 2 a stream of 182 g/h of PEG6000 (component A) at 85° C. and a stream of 28.6 g/h of Lutensol® XL 100 (component D) at 85° C. and a stream of 12.6 g/h of a 25 wt.-% of Trigonox® 21 S solution in tripropylene glycol (component C) at room temperature were fed. A stream of 273 g/h of vinyl acetate (component B) was fed to the feed side of the tubular reactor segment 2*a* at room temperature. The temperature of tubular reactor segments 2 to 2*g* was 95° C. The pressure at the outlet side of 2*g* was regulated by a pressure regulation bar and kept constant at 4 bar.

Example 3

To the feed side of the tubular reactor segment 2 a stream of 137 g/h of PEG 6000 (component A) at 85° C. and a stream of 21.6 g/h of Lutensol® XL 100 (component D) at 85° C. and a stream of 9.5 g/h of a 25 wt % of Trigonox® 21 S solution in tripropylene glycol (component C) were fed at room temperature. A stream of 205.5 g/h of vinyl acetate (component B) was fed to the feed side of the tubular reactor segment 2*a* at room temperature. The temperature of tubular reactor segments 2 to 2*g* was 95° C. The pressure at the outlet side of 2*g* was regulated by a pressure regulation bar and kept constant at 5 bar.

Example 4

To the feed side of tubular reactor segment 2 a stream of 91 g/h of PEG 6000 (component A) at 85° C. and a stream of 14.3 g/h of Lutensol® XL 100 (component D) at 85° C. and a stream of 6.3 g/h of a 25 wt % of Trigonox® 21 S solution in tripropylene glycol (component C) at room temperature were fed. A stream of 136.5 g/h of vinyl acetate (component B) was fed to the feed side of the tubular reactor segment 2*a* at room temperature. The temperature of tubular reactor segments 2 to 2*g* was 95° C. The pressure at the outlet side of 2*g* was regulated by a pressure regulation bar and kept constant at 6 bar.

Example 5

To the feed side of tubular reactor segment 2 a stream of 167.7 g/h of PEG 6000 (component A) at 85° C. and a stream of 26.4 g/h of Lutensol® XL 100 (component D) at 85° C. and a stream of 20.8 g/h of a 25 wt % of Trigonox® 21 S solution in tripropylene glycol (component C) were fed at room temperature. A stream of the outlet side of the tubular reactor segment 2*e* was recycled back with a gear pump to the feed side of the tubular reactor segment 2 at a rate of 600 g/h. In the recycle stream a stream of 251.6 g/h of vinyl acetate (component B) was fed directly before the gear pump (between tubular reactor segment 2*e* outlet side and tubular reactor segment 2 feed side) at room temperature. The temperature of tubular reactor segments 2 to 2*g* was 94° C. The pressure at the outlet side of 2*g* was regulated by a pressure regulation bar and kept constant at 6 bar.

Example 6

To the feed side of tubular reactor segment 2 a stream of 167.7 g/h of PEG 6000 (component A) at 85° C. and a stream of 26.4 g/h of Lutensol® XL 100 (component D) at 85° C. and a stream of 20.8 g/h of a 25 wt % of Trigonox® 21 S solution in tripropylene glycol (component C) were fed at room temperature. A stream of the outlet side of the tubular reactor segment 2*c* was recycled back with a gear pump to the feed side of the tubular reactor segment 2 at a rate of 180 g/h. In the recycle stream a stream of 106.1 g/h of vinyl acetate (component B) was fed directly before the gear pump (between tubular reactor segment 2*c* outlet side and tubular reactor segment 2 feed side) at room temperature. The temperature of tubular reactor segments 2 to 2*g* was 95° C. To the feed side of the tubular reactor segments 2*d* and 2*f* two streams of vinyl acetate (component B), each of 72.7 g/h, were fed at room temperature. The pressure at the outlet side of 2*g* was regulated by a pressure regulation bar and kept constant at 6 bar.

Example 7

A stream of 167.7 g/h of PEG 6000 (component A) at 85° C. and a stream of 20.8 g/h of a 25 wt % of Trigonox® 21 S solution in tripropylene glycol (component C) were fed at room temperature to the feed side of tubular reactor segment 2. A stream of the outlet side of the tubular reactor segment 2*c* was recycled back with a gear pump to the feed side of the tubular reactor segment 2 at a rate of 180 g/h. In the recycle stream a stream of 106.1 g/h of vinyl acetate (component B) was fed directly before the gear pump (between tubular reactor segment 2*c* outlet side and tubular reactor segment 2 feed side) at room temperature. The temperature of tubular reactor segments 2 to 2*g* was 95° C. To the feed side of the tubular reactor segments 2*d* and 2*f* two streams of vinyl acetate (component B), each of 72.7 g/h, were fed at room temperature. The pressure at the outlet side of 2*g* was regulated by a pressure regulation bar and kept constant at 6 bar.

Example 8

A stream composed of a mixture of 167.7 g/h of PEG 6000 and 26.4 g/h of Lutensol® XL 100 at 85° C. and a stream of 251.7 g/h of vinyl acetate at room temperature were fed to the feed side of the tubular reactor segment 2. A stream of the outlet of the tubular reactor segment 2*c* was recycled back with a gear pump to the feed side of the tubular reactor segment 2 at a rate of 4500 g/h. A stream of 10.3 g/h of a 25 wt % of Trigonox® 21 S solution in tripropylene glycol at room temperature was fed to the feed side of segment 2*f*. The temperature of the tubular reactor segments 2-2*c* was 93° C. The temperature of the tubular reactor segments 2*d*-2*g* was 93° C. The pressure at the outlet side of 2*g* was regulated by a pressure regulation bar and kept constant at 6 bar.

Example 9

A stream of 167.7 g/h of PEG 6000 at 85° C. and a stream of 251.7 g/h of vinyl acetate at room temperature were fed to the feed side of the tubular reactor segment 2. A stream of the outlet of the tubular reactor segment 2*c* was recycled back with a gear pump to the feed side of the tubular reactor segment 2 at a rate of 4500 g/h. A stream of 10.3 g/h of a 25 wt % of Trigonox® 21 S solution in tripropylene glycol at room temperature was fed to the feed side of segment 2*f*. The temperature of the tubular reactor segments 2-2*c* was 93° C. The temperature of the tubular reactor segments 2*d*-2*g* was 93° C. The pressure at the outlet side of 2*g* was regulated by a pressure regulation bar and kept constant at 6 bar.

Example 10

A stream composed of a mixture of 132.2 g/h of PEG 6000 at 85° C. was fed to the feed side of reactor segment 2. A stream of 198.3 g/h of vinyl acetate at room temperature was fed to feed side of segment 2*d* and a stream of 9.1 g/h of a 25 wt % of Trigonox® 21 S solution in tripropylene glycol at room temperature were fed to the feed side of the tubular reactor segment 2*c*. A stream of the outlet of the tubular reactor segment 2*d* was recycled back with a gear pump to the feed side of the tubular reactor segment 2*e* at a rate of 3200 g/h. To the feed side of the tubular reactor segment 2*f* a stream of 7.2 g/h of a 25 wt % of Trigonox® 21 S solution in tripropylene glycol at room temperature were fed. The temperature of the tubular reactor segments 2-2*c* was 88° C. The temperature of the tubular reactor segments 2*d*-2*g* was 91° C. The pressure at the outlet side of 2*g* was regulated by a pressure regulation bar and kept constant at 6 bar.

Example 11

A stream of 182 g/h of PEG 6000 at 85° C. and a stream of 273 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4500 g/h. A stream of 10 g/h of a 25 wt % of Trigonox® 21 S solution in tripropylene glycol at room temperature were fed in this recycled stream directly before the gear pump (at the suction side). The temperature of the tubular reactor segments 2-2*c* was 90° C. The temperature of the tubular reactor segments 2*d*-2*g* was 88° C. The pressure at the outlet side of 2*g* was regulated by a pressure regulation bar and kept constant at 6 bar.

Example 12

A stream of 182 g/h of PEG 6000 at 85° C. and a stream of 273 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4500 g/h. A stream of 5 g/h of a 25 wt % of Trigonox® 21 S solution in tripropylene glycol at room temperature were fed in this recycled stream directly before the gear pump (at the suction side). The temperature of the tubular reactor segments 2-2*c* was 90° C. The temperature of the tubular reactor segments 2*d*-2*g* was 88° C. The pressure at the outlet side of 2*g* was regulated by a pressure regulation bar and kept constant at 6 bar.

Example 13

A stream of 178 g/h of PEG 6000 at 85° C. and a stream of 267 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4500 g/h. A stream of 20 g/h of a 25 wt % of Trigonox® 21 S solution in tripropylene glycol at room temperature were fed in this recycled stream directly before the gear pump (at the suction side). The temperature of the tubular reactor segments 2-2*c* was 90° C. The temperature of the tubular reactor segments 2*d*-2*g* was 88° C. The pressure at the outlet side of 2 g was regulated by a pressure regulation bar and kept constant at 6 bar.

Example 14

A stream of 303 g/h of PEG 6000 at 85° C. and a stream of 151.5 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4500 g/h. A stream of 10 g/h of a 25 wt % of Trigonox® 21 S solution in tripropylene glycol at room temperature were fed in this recycled stream directly before the gear pump (at the suction side). The temperature of the tubular reactor segments 2-2*c* was 90° C. The temperature of the tubular reactor segments 2*d*-2*g* was 88° C. The pressure at the outlet side of 2*g* was regulated by a pressure regulation bar and kept constant at 6 bar.

Example 15

A stream of 303 g/h of PEG 6000 at 85° C. and a stream of 151.5 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 9000 g/h. A stream of 10 g/h of a 25 wt % of Trigonox® 21 S solution in tripropylene glycol at room temperature were fed in this recycled stream directly before the gear pump (at the suction side). The temperature of the tubular reactor segments 2-2*c* was 90° C. The temperature of the tubular reactor segments 2*d*-2*g* was 88° C. The pressure at the outlet side of 2*g* was regulated by a pressure regulation bar and kept constant at 6 bar.

Example 16

A stream of 182 g/h of PEG 6000 at 85° C. and a stream of 136.5 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4500 g/h. A stream of 10 g/h of a 25 wt % of Trigonox® 21 S solution in tripropylene glycol at room temperature were fed in this recycled stream directly before the gear pump (at the suction side). The temperature of the tubular reactor segments 2-2*c* was 92° C. A stream of the outlet of the tubular reactor segment 2*d* was recycled back with a gear pump to a dynamic mixer connected to the feed side of 2*d* at a rate of 4500 g/h (the recycled stream enters the gear pump→dynamic mixer→feed seed of 2*d*). A stream of 136.5 g/h of vinyl acetate at room temperature was fed in this recycled stream directly before the gear pump (at the suction side). The temperature of the tubular reactor segments 2*d*-2*g* was 93° C. and the pressure at the outlet side of the segment 2*g* was regulated with a regulation valve at 6 bar.

Example 17

A stream of 182 g/h of PEG 6000 at 85° C. and a stream of 182 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4500 g/h. A stream of 10 g/h of a 25 wt % of Trigonox® 21 S solution in tripropylene glycol at room temperature were fed in this recycled stream directly before the gear pump (at the suction side). The temperature of the tubular reactor segments 2-2*c* was 92° C. A stream of the outlet of the tubular reactor segment 2*d* was recycled back with a gear pump to a dynamic mixer connected to the feed side of 2*d* at a rate of 4500 g/h (the recycled stream enters the gear pump→dynamic mixer→feed seed of 2*d*). A stream of 91 g/h of vinyl acetate at room temperature was fed in this recycled stream directly before the gear pump (at the suction side). The temperature of the tubular reactor segments 2*d*-2*g* was 93° C. and the pressure at the outlet side of the segment 2*g* was regulated with a regulation valve at 5 bar.

Example 18

A stream composed of a mixture of 162.7 g/h of PEG 6000 and 25.6 g of Lutensol XL100 at 85° C. and a stream of 122 g/h of vinyl acetate at room temperature were fed to a dynamic mixer that is attached to the feed side of segment 2. A stream of the outlet of the tubular reactor segment 2*c* was recycled back with a gear pump to the feed side of the tubular reactor segment 2 at a rate of 4500 g/h. A stream of 10 g/h of a 25 wt % of Trigonox® 21 S solution in tripropylene glycol at room temperature were fed in this recycled stream directly before the gear pump (at the suction side). The temperature of the tubular reactor segments 2-2*c* was 92° C. A stream of the outlet of the tubular reactor segment 2*d* was recycled back with a gear pump to a dynamic mixer connected to the feed side of 2*d* at a rate of 4500 g/h (the recycled stream enters the gear pump→dynamic mixer→feed seed of 2*d*). A stream of 122 g/h of vinyl acetate at room temperature was fed in this recycled stream directly before the gear pump (at the suction side).

The temperature of the tubular reactor segments 2*d*-2*g* was 93° C. and the pressure at the outlet side of the segment 2*g* was regulated with a regulation valve at 5 bar.

Example 19

A stream of 261 g/h of PEG 6000 at 85° C. and a stream of 97.9 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 9600 g/h. A stream of 10 g/h of a 25 wt % of Trigonox® 21 S solution in tripropylene glycol at room temperature were fed in this recycled stream directly before the gear pump (at the suction side). The temperature of the tubular reactor segments 2-2*c* was 92° C. A stream of the outlet of the tubular reactor segment 2*d* was recycled back with a gear pump to a dynamic mixer connected to the feed side of 2*d* at a rate of 9,600 g/h (the recycled stream enters the gear pump→dynamic mixer→feed seed of 2*d*). A stream of 97.9 g/h of vinyl acetate at room temperature was fed in this recycled stream directly before the gear pump (at the suction side). The temperature of the tubular reactor segments 2*d*-2*g* was 93° C. and the pressure at the outlet side of the segment 2*g* was regulated with a regulation valve at 5 bar.

Example 20

A stream of 258 g/h of PEG 6000 at 85° C. and a stream of 96.8 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4500 g/h. A stream of 14.3 g/h of a 25 wt % of Trigonox® 21 S solution in tripropylene glycol at room temperature were fed in this recycled stream directly before the gear pump (at the suction side). The temperature of the tubular reactor segments 2-2*c* was 92° C. A stream of the outlet of the tubular reactor segment 2*d* was recycled back with a gear pump to a dynamic mixer connected to the feed side of 2*d* at a rate of 4500 g/h (the recycled stream enters the gear pump→dynamic mixer→feed seed of 2*d*). A stream of 96.8 g/h of vinyl acetate at room temperature was fed in this recycled stream directly before the gear pump (at the suction side). The temperature of the tubular reactor segments 2*d*-2*g* was 93° C. and the pressure at the outlet side of the segment 2*g* was regulated with a regulation valve at 5 bar.

Example 21

A stream of 228 g/h of PEG 6000 at 85° C. and a stream of 114 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4800 g/h. A stream of 12.7 g/h of a 25 wt % of Trigonox® 21 S solution in tripropylene glycol at room temperature were fed in this recycled stream directly before the gear pump (at the suction side). The temperature of the tubular reactor segments 2-2*c* was 92° C. A stream of the outlet of the tubular reactor segment 2*d* was recycled back with a gear pump to a dynamic mixer connected to the feed side of 2*d* at a rate of 4800 g/h (the recycled stream enters the gear pump→dynamic mixer→feed seed of 2*d*). A stream of 114 g/h of vinyl acetate at room temperature was fed in this recycled stream directly before the gear pump (at the suction side). The temperature of the tubular reactor segments 2*d*-2*g* was 93° C. and the pressure at the outlet side of the segment 2*g* was regulated with a regulation valve at 5 bar.

Example 22

A stream of 180 g/h of PEG 6000 at 85° C. and a stream of 270 g/h of vinyl acetate at room temperature were fed to a dynamic mixer that is attached to feed side of segment 2. A stream of the outlet of the tubular reactor segment 2*c* was recycled back with a gear pump to the feed side of the tubular reactor segment 2 at a rate of 4500 g/h. A stream of 15 g/h of a 25 wt % of Trigonox® 21 S solution in tripropylene glycol at room temperature were fed in this recycled stream directly before the gear pump (at the suction side). The temperature of the tubular reactor segments 2-2*c* was 90° C. The temperature of the tubular reactor segments 2*d*-2*g* was 88° C. The pressure at the outlet side of 2 g was regulated by a pressure regulation bar and kept constant at 5 bar.

Example 23

The reactor is made up of 3 segments denoted as 2, 2*a* and 2*b*. Segment 2 is a steel tube with a length of 20 m and internal diameter of 4 mm with a void volume of 251 ml. Segment 2*a* is a steel tube with a length of 10 m and internal diameter of 6 mm with a void volume of 283 ml. Segment 2*b* is a steel tube with a length of 10 m and internal diameter of 8 mm with a void volume of 283 ml. These 3 segments were immersed in oil bath. These tubular reactor segments have been operated in series, where the outlet of segment 2 is connected to the feed side of the segment 2*a* and the outlet of segment 2*a* is connected to the feed side of the segment 2*b*. A stream composed of a mixture of 255 g/h of PEG 6000, 67 g/h of Lutensol® XL 100 and 158 g/h and 31.5 g of a 25 wt % of Trigonox® 21 S solution in tripropylene glycol at 60° C. were fed to the feed side of segment 2. A stream of the outlet side of segment 2*a* was recycled back with a gear pump to the feed side of segment 2 at a rate of 696 g/h. The oil bath in which the 3 reactor segments were immersed had a temperature of 90° C. Segment 2 had a pressure of 6.9 bar, segment 2*a* had a pressure of 6.4 bar and segment 2*b* had a pressure of 3.9 bar.

Example 24

Materials:

Polyalkylene glykol A: PEG 4000, polyethylene glycol with molecular weight of Mn 4000 g/mol, available for example as Pluriol® E4000.

Monomer B: Vinyl acetate and Butyl acrylate

Figure 9:
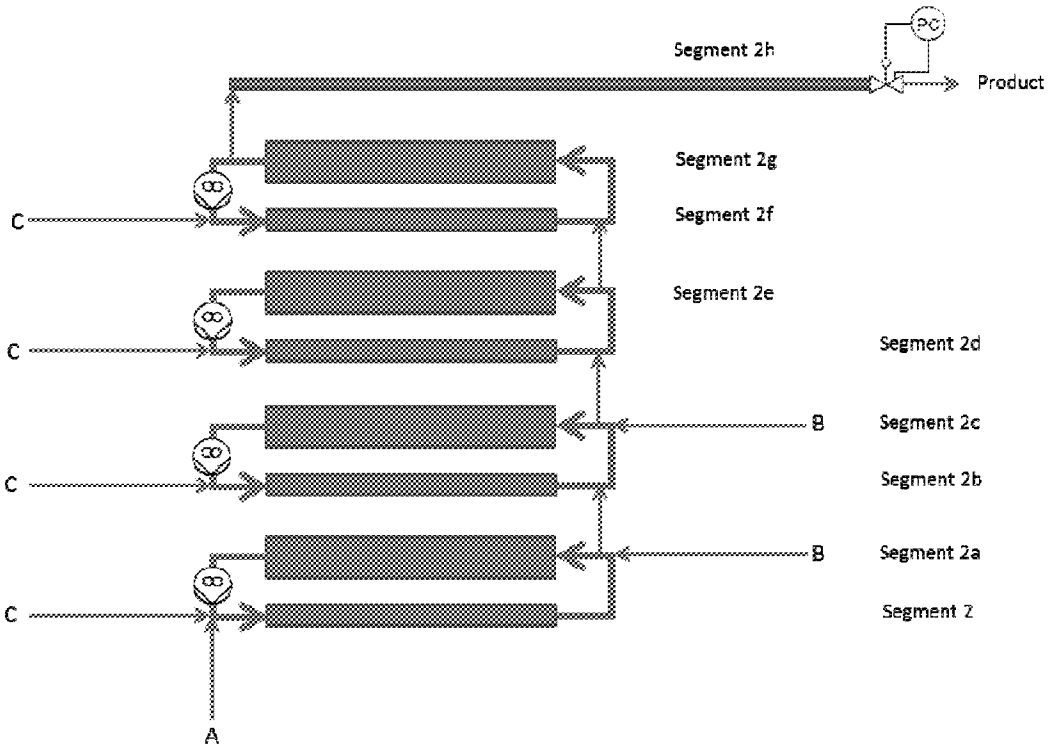
FIG. 9 shows reactor segments used to run the polymerization of Example 24.

Initiator C: tert.-Butylperoxy-2-ethylhexanoate: for example available as "Trigonox® 21 S" from Akzo Nobel The eight tubular reactor segments denoted as 2-2*h* (see FIG. 9) were used to run the polymerization. The void volume of the tubular reactor segments 2, 2*b*, 2*d*, and 2*f* is 56.5 ml each and that of the tubular reactor segments 2*a*, 2*c*, 2*e*, and 2*g* is 208 ml. The segment 2*h* has an inner diameter of 6 mm and a length of 2 m and a volume of 56.5 ml. Each of the tubular reactor segments 2-2*g* is 50 cm long and the inner diameter of the tubular reactor segments 2, 2*b*, 2*d*, and 2*f* is 1.2 cm and that of the tubular reactor segments 2*a*, 2*c*, 2*e*, and 2*g* is 2.3 cm. These tubular reactor segments were empty and no inserts like static mixers were used and they have 'inlet' denoted as the feed side and 'outlet' denoted as outlet side. The pumps used in this setup were gear pumps from the company Gather.

These tubular reactor segments were connected to form 4 Loops in series. Each Loop was consisting of 2 segments (Loop 1: Segment 2 and 2*a*, Loop 2: Segment 2*b* and 2*c*, Loop 3: Segment 2*d* and 2*e*, Loop 4: Segment 2*f* and 2*g*), where the outlet side of one segment was recycled to the feed side of the second segment making the loop. Each Loop was consisting of one big segment (i.e. inner diameter of 2.3 cm) and one small segment (i.e. inner diameter of 1.2 cm).

A stream of the outlet side of the tubular reactor segment 2*a* was recycled back with a gear pump to the feed side of the tubular reactor segment 2 at a rate of 108 kg/h.

A stream of the outlet side of the tubular reactor segment 2*c* was recycled back with a gear pump to the feed side of the tubular reactor segment 2*b* at a rate of 108 kg/h.

A stream of the outlet side of the tubular reactor segment 2*e* was recycled back with a gear pump to the feed side of the tubular reactor segment 2*d* at a rate of 92 kg/h.

A stream of the outlet side of the tubular reactor segment 2*g* was recycled back with a gear pump to the feed side of the tubular reactor segment 2*f* at a rate of 80 kg/h.

To the feed side of the tubular reactor segment 2 a stream composed of 369 g/h of PEG 4000 (component A) was fed.

2 streams, each 123 g/h of a mixture of vinyl acetate and Butyl acrylate (92 wt % Vinyl acetate and 8 wt % Butyl acrylate) (component B) at room temperature were fed to loop 1 and loop 2 at the feed side of segment 2*a* and 2*c* respectively.

2 streams (each 10.3 g/h) of a 25 wt % of Trigonox® 21 S solution in tripropylene glycol (component C) at room temperature were fed in the recycle stream of Loop 1 and Loop 2 directly after the gear pump (at the pressure side).

Also, 2 streams (each 5.1 g/h) of a 25 wt % of Trigonox® 21 S solution in tripropylene glycol (component C) at room temperature were fed in the recycle stream of Loop 3 and Loop 4 directly after the gear pump (at the pressure side).

The temperature of the tubular reactor segments 2-2*g* was 105° C. The temperature of the tubular reactor segment 2*h* was 120° C.

The pressure at the outlet side of 2*h* was regulated by a pressure regulation valve and was kept constant at 15 bar.

Example 25

Materials:

Polyalkylene glykol A: PEG 4000, polyethylene glycol with molecular weight of Mn 4000 g/mol, available for example as Pluriol® E4000.

Monomer B: Vinyl acetate and Butyl acrylate

Initiator C: tert.-Butylperoxy-2-ethylhexanoate: for example available as "Trigonox® 21 S" from Akzo Nobel Additive D1: Nonionic (NIO) surfactant 1: alkoxylated singly-branched C10-guerbet alcohol, cloud point approx. 80° C. (measured according to EN 1890, method A), available as Lutensol® XL100

Figure 10:
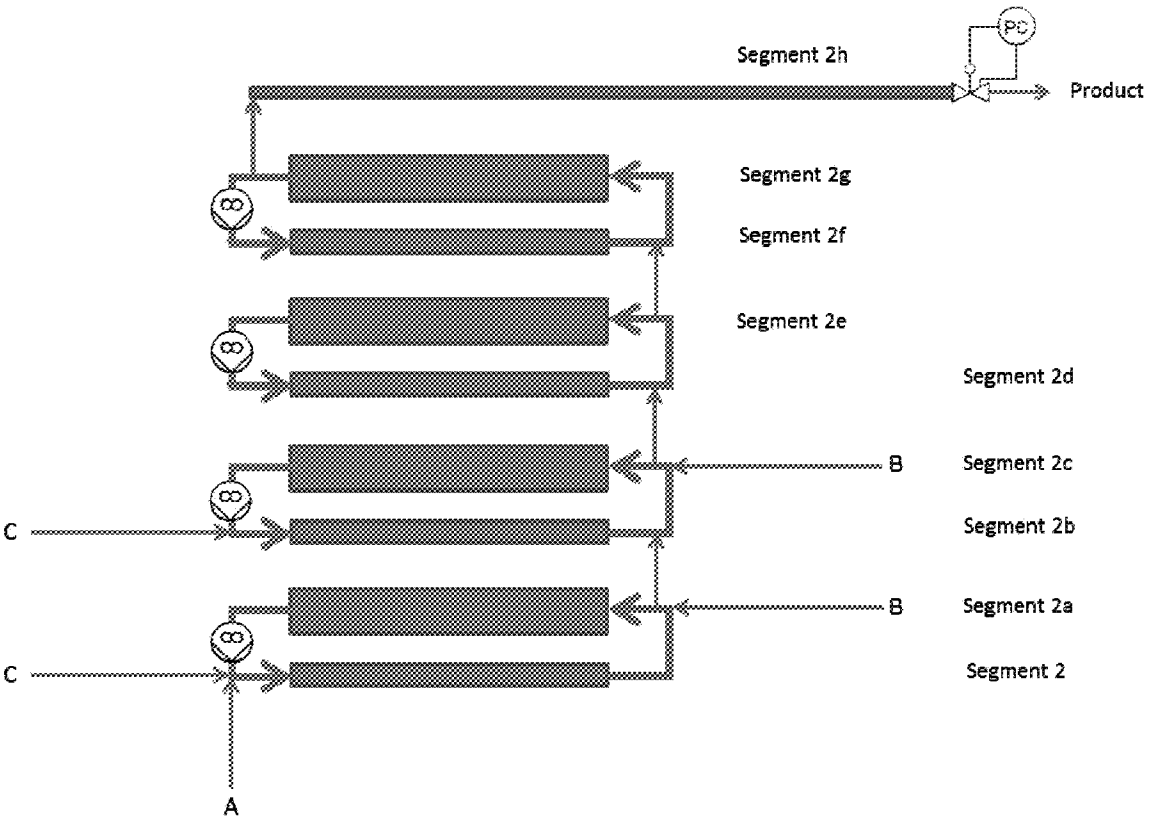
FIG. 10 shows reactor segments used to run the polymerization of Example 25.

The eight tubular reactor segments denoted as 2-2*h* (see FIG. 10) were used to run the polymerisation. The void volume of the tubular reactor segments 2, 2*b*, 2*d*, and 2*f* is 56.5 ml each and that of the tubular reactor segments 2*a*, 2*c*, 2*e*, and 2*g* is 208 ml. The segment 2*h* has an inner diameter of 6 mm and a length of 2 m and a volume of 56.5 ml. Each of the tubular reactor segments 2-2*g* is 50 cm long and the inner diameter of the tubular reactor segments 2, 2*b*, 2*d*, and 2*f* is 1.2 cm and that of the tubular reactor segments 2*a*, 2*c*, 2*e*, and 2*g* is 2.3 cm. These tubular reactor segments were empty and no inserts like static mixers were used and they have 'inlet' denoted as the feed side and 'outlet' denoted as outlet side. The pumps used in this setup were gear pumps from the company Gather.

These tubular reactor segments were connected to form 4 Loops in series. Each Loop was consisting of 2 segments (Loop 1: Segment 2 and 2*a*, Loop 2: Segment 2*b* and 2*c*, Loop 3: Segment 2*d* and 2*e*, Loop 4: Segment 2*f* and 2*g*), where the outlet side of one segment was recycled to the feed side of the second segment making the loop. Each Loop was consisting of one big segment (i.e. inner diameter of 2.3 cm) and one small segment (i.e. inner diameter of 1.2 cm).

A stream of the outlet side of the tubular reactor segment 2*a* was recycled back with a gear pump to the feed side of the tubular reactor segment 2 at a rate of 108 kg/h.

A stream of the outlet side of the tubular reactor segment 2*c* was recycled back with a gear pump to the feed side of the tubular reactor segment 2*b* at a rate of 108 kg/h.

A stream of the outlet side of the tubular reactor segment 2*e* was recycled back with a gear pump to the feed side of the tubular reactor segment 2*d* at a rate of 92 kg/h.

A stream of the outlet side of the tubular reactor segment 2*g* was recycled back with a gear pump to the feed side of the tubular reactor segment 2*f* at a rate of 80 kg/h.

To the feed side of the tubular reactor segment 2 a stream composed of 423.4 g/h at 80° C. of PEG 4000 (component A) and 66.6 g/h of Lutensol XL100 (Component D1) was fed.

2 streams, each 212.8 g/h of vinyl acetate (component B) at room temperature were fed to loop 1 and loop 2 at the feed side of segment 2*a* and 2*c* respectively.

2 streams (each 27.1 g/h) of a 25 wt % of Trigonox® 21 S solution in tripropylene glycol (component C) at room temperature were fed in the recycle stream of Loop 1 and Loop 2 directly after the gear pump (at the pressure side).

The temperature of the tubular reactor segments 2-2*g* was 105° C. The temperature of the tubular reactor segment 2*h* was 120° C.

The pressure at the outlet side of 2*h* was regulated by a pressure regulation valve and was kept constant at 15 bar.

Comparative Example 1

A graft polymer of the composition PEG6000 (40 wt.-%)/vinyl acetate (60 wt.-%) is prepared in a semibatch process according to EP-A-219 048 is prepared.

Comparative Example 2

A graft polymer of the composition PEG6000 (40 wt.-%)/vinyl acetate (60 wt.-%) is prepared in a semibatch process according to WO 2007/138053 A1.

Comparative Example 3

A graft polymer of the composition PEG4000 (40 wt.-%)/vinyl acetate (60 wt.-%) is prepared in a semibatch process according to WO 2007/138053 A1.

Data

Table 2 shows the polarity distribution characterized by a maximum of the polarity distribution and the full width at half maximum at the polarity distribution. The data in Table 2 was collected using the GPEC method described above.

TABLE 2

| | Maximum of the polarity distribution | Full width at half maximum |
|---|---|---|
| Example 23 | 0.529 | 0.42 |
| Example 1 | 0.502 | 0.43 |
| Example 22 | 0.500 | 0.61 |
| Example 12 | 0.556 | 0.50 |
| Example 24 | 0.595 | 0.39 |
| Comparative Example 1 | 0.407 | 0.28 |
| Comparative Example 2 | 0.413 | 0.32 |
| Comparative Example 3 | 0.700 | 0.28 |

Table 3 shows whiteness results (anti redeposition of soil) for the polymer of Comparative Example 2 as well as the polymer of Example 1. The detergent compositions contained 13% C11.8 Alkylbenzene sulfonate, 5% Zeolite, 30% Sodium Carbonate, 17% Sodium Sulphate, 30% Sodium Chloride, 5% Miscellaneous/Water. The data in Table 3 was collected using the "Method to Determine Whiteness Maintenance and Results," as described above. Results: expressed as WI or delta WI from L*a*b* values obtained by the Spectrolino measurement using the CIE WI scale widely known from the literature.

TABLE 3

| Whiteness Results (anti redeposition of soil) | ΔWI Detergent + Comparative Example 2 | ΔWI Detergent + Example 1 (Sample 1*) | ΔWI Detergent + Example 1 (Sample 2*) | ΔWI Detergent + Example 1 (Sample 3*) |
|---|---|---|---|---|
| Carbon Black/Oil Mix | | | | |
| Polyester pre-treated with FE | 0.0 | +0.4 | −0.7 | −0.1 |
| Cotton | 0.0 | +2.1 | +0.6 | +2.0 |
| Ave. across fabrics | 0.0 | +1.3 | −0.1 | +1.0 |
| Clay/Oil Mix on | | | | |
| Polyester pre-treated with FE | 0.0 | +1.1 | +0.3 | +0.7 |
| Cotton | 0.0 | +5.6 | +6.0 | +5.4 |
| Ave. across fabrics | 0.0 | +3.4 | +3.2 | +3.1 |
| Overall Whiteness Maintenance | | | | |
| Overall Ave. across fabric/soil | 0.0 | +2.3 | +1.6 | +2.0 |

*Samples 1, 2, and 3 are different samples from a large scale production of the Example 1 polymer.

In another set of experiments, the detergent raw materials according to Table 4 were dissolved completely in 600 grams of de-ionized triply filtered Millipore water. This is referred to as the wash solution.

TABLE 4

| Detergent Formulation | |
|---|---|
| Detergent Material | Concentration (ppm) |
| $C_{11.8}$ Alkylbenzene sulfonate | 585 |
| $C_{12-15}$ Alkylethoxy(3) sulphate | 57 |
| $C_{14-15}$ Alkyl-7-ethoxylate | 76 |
| Hydroxyethane diphosphonic acid | 37 |
| Sodium Carbonate | 1584 |
| Sodium Sulfate | 2111 |
| NaOH | pH adjust to 10.3 |

Add 366 micro-liters 10% Comparative Example 2 or 366 micro-liters 10% Example 1 (Sample 1) or 366 micro-liters 10% Example 1 (Sample 2) or 366 micro-liters 10% Example 1 (Sample 3). Transfer 14 ml of the wash solution into 20 ml glass vials. Add Teflon coated magnets for additional agitation. Add 28 micro-liters of 1% stock hardness solution to the wash solution. A 1% solution of water hardness was prepared according to the following procedure.

Preparation of 1% Hardness Stock solution: Into a 1 L beaker, add 168.09 g $CaCl_2$-$2H_2O$ and 116.22 g $MgCl_2$-$6H_2O$. Add 800 mL of de-ionized water. Using a stir bar and stirring plate, stir until dissolved and the solution turns clear. Pour solution into a 1 L volumetric flask and fill to line. Add stirring bar into flask and stir again for ~5 mins. Remove stir bar and refill to line. Store solution in plastic bottle until use.

Add 6.1 micro-liters of Artificial Body soil to wash solution in the 20 ml glass vials. Artificial body soil composition was prepared according to Table 5.

TABLE 5

| Artificial Body Soil Composition. | | |
|---|---|---|
| Ingredients | wt % | Supplier/Identification |
| Palm Kernel Fatty Acid | 15 | Peter Cremer/RMS 25956 |
| Oleic Acid | 15 | Ch. Store/Riedel-de Haen |
| Paraffin Oil | 15 | Ch. Store/Uvasol |
| Olive Oil | 15 | GB |
| Soja Oil | 15 | GB |
| Squalene | 5 | FLUKA |
| Cholesterol 95% | 5 | ALDRICH |
| Myristic Acid 95% | 5 | ALDRICH |
| Palmitic Acid 95% | 5 | SIGMA |
| Stearic Acid 90%+ | 5 | SIGMA |
| Total | 100 | |

Add 42 mg of technical soil to the wash solution in 20 ml glass vials. In this experiment we used Arizona Test Dust (0-3) purchased from Powder Technology Inc. and Carbon Black 1333-84-4 purchased from Fisher Chemical. Add nine 1.5 cm diameter polyester fabric (PW19) and nine 1.5 cm diameter cotton fabrics (CW120) purchased from Empirical Manufacturing Company (Blue Ash, Cincinnati) to 20 ml glass vial wash solution. Secure 20 ml wash vial tightly to Wrist Action Shaker Model 75 (Burrell Scientific, Pittsburgh, Pa.). Use a timer and run the wash for 30 minutes. At the end of the wash empty the contents of the glass vial wash solution on a buchner funnel. Transfer the fabric disks to another 20 ml vial and add 14 ml of rinse solution. To prepare the rinse solution again add 28 microliters of 1% hardness solution to 14 ml of de-ionized filtered water. Secure vial to Wrist Action Shaker and rinse for 3 minutes. At the end of the rinse remove from Wrist Action Shaker and place the fabrics on black plastic board template. Let air dry for at least two hours. Fabrics are evaluated for loss of whiteness using image analysis. CIELAB is conveniently converted and reported as Whiteness Index CIE. CIE Whiteness is the most commonly used whiteness index normally refers to measurements made under D65 illumination, which is a standard representation of outdoor daylight. For a perfect reflecting, non-fluorescent white material, the CIE Whiteness would be 100. In technical terms, whiteness is a single number index referencing the relative degree of whiteness (of near-white materials under specific lighting conditions). The index has been devised such that most people will agree that the higher the whiteness, the whiter the material.

TABLE 6

| Technical Soil used in this experiment Arizona Test Dust + Artificial Body Soil (Charged, Polar Soil) | |
|---|---|
| PW19 (polyester) | ΔWI Vs Detergent + Comparative example 2 |
| A: Detergent nil polymer | −25.9 |
| B: A+ Comparative Example 2 | 0.0 |
| C: A+ Example 1 (Average Samples 1, 2, 3*) | +4.1 |

*Samples 1, 2, and 3 are different samples from a large scale production of the Example 1 polymer.

Results:

TABLE 7

| Technical Soil used in this experiment Arizona Test Dust + Artificial Body Soil (Charged, Polar Soil) | |
|---|---|
| CW120 (Cotton) | ΔWI Vs Detergent + Comparative example 2 |
| A: Detergent nil polymer | −2.6 |
| B: A+ Comparative Example 2 | 0.0 |
| C: A+ Example 1 (Average Samples 1, 2, 3*) | +1.1 |

*Samples 1, 2, and 3 are different samples from a large scale production of the Example 1 polymer.

TABLE 8

| Technical Soil used in this experiment Carbon Black + Artificial Body Soil (Uncharged, Unpolar Soil) | |
|---|---|
| PW19 (polyester) | ΔWI Vs Detergent + Comparative example 2 |
| A: Detergent nil polymer | −17.0 |
| B: A+ Comparative example 2 (RD176949) | 0.0 |
| C: A+ Example 1 (Average Samples 1, 2, 3*) | 0.4 |

*Samples 1, 2, and 3 are different samples from a large scale production of the Example 1 polymer.

TABLE 9

| Technical Soil used in this experiment Carbon Black + Artificial Body Soil (Uncharged, Unpolar Soil) | |
|---|---|
| CW120 (cotton) | ΔWI Vs Detergent + Comparative example 2 |
| A: Detergent nil polymer | −5.5 |
| B: A+ Comparative example 2 (RD176949) | 0.0 |
| C: A+ Example 1 (Average Samples 1, 2, 3*) | +1.1 |

*Samples 1, 2, and 3 are different samples from a large scale production of the Example 1 polymer.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising an amphiphilic graft polymer based on water-soluble polyalkylene oxides (A) as a graft base and side chains formed by polymerization of a vinyl ester component (B), said polymer having mean molar masses $M_w$ of from 3000 to 100,000 and comprising A. from 15% to 70% by weight of a water-soluble polyalkylene oxide as a graft base and B. side chains formed by free-radical polymerization of from 30 to 85% by weight of a vinyl ester component composed of (B1) from 70 to 100% by weight of vinyl acetate and/or vinyl propionate and (B2) from 0 to 30% by weight of a further ethylenically unsaturated monomer wherein said graft polymer has an average of less than or equal to 1 graft site per 50 alkylene oxide units and wherein said polymer has a full width at half maximum of the polarity distribution between 0.35 and about 1.0.

2. The composition of claim 1 wherein said graft polymer has a maximum of the polarity distribution between about 0.45 and about 1.

3. The composition according to claim 1, wherein said graft polymer has a polydispersity $M_w/M_n$ of less than or equal to 3.

4. The composition according to claim 1, wherein said graft polymer comprises less than 10% by weight of polyvinyl ester (B) in ungrafted form.

5. The composition according to claim 1, wherein said graft polymer comprises less than 30% ungrafted polyethylene glycol.

6. The composition according to claim 1, wherein said graft polymer comprises from 25 to 60% by weight of the graft base (A) and from 40 to 75% by weight of the vinyl ester component (B).

7. The composition according to claim 1, wherein the vinyl ester component (B) of said graft polymer comprises from 70 to 100% by weight of vinyl acetate (B1) and from 0 to 30% by weight of a $C_1$-$C_8$-alkyl acrylate (B2).

8. The composition according to claim 1, wherein the polyalkylene oxide (A) of said graft polymer is based on $C_2$ to $C_4$-alkylene oxide, which comprises at least 30% by weight of ethylene oxide in copolymerized form.

9. The composition according to claim 1, wherein the polylalkylene oxide (A) of said graft polymer has a mean molecular weight $M_n$ from 2000 to 15000 g/mol.

10. The composition according to claim 1, wherein the polylalkylene oxide (A) of said graft polymer has a polydispersity $M_w/M_n$ of less than or equal to 2.5.

11. A method of laundering fabric comprising the step of contacting said fabric with the composition according to claim 1.

* * * * *